US006017011A

United States Patent [19]

Lee

[11] Patent Number: 6,017,011

[45] Date of Patent: Jan. 25, 2000

[54] COLLAPSIBLE MUSIC STAND WITH OPTIONAL MULTIPLE DESKS HAVING DUAL-ANGULAR AND VERTICLE ADJUSTABILITY

[75] Inventor: Richard Lee, Menlo Park, Calif.

[73] Assignee: Alden Lee Comapny, Inc., Menlo Park, Calif.

[21] Appl. No.: 08/706,166

[22] Filed: Aug. 30, 1996

[51] Int. Cl.[7] ..... A47B 19/00; A47B 23/00; A47B 97/04

[52] U.S. Cl. ..... 248/441.1; 248/457; 248/188.5; 248/113; 248/460; 403/109; 403/327; 312/233

[58] Field of Search ..... 248/441.1, 457, 248/188.5, 113, 460, 411, 413; 297/135; 312/233; 403/109, 327

[56] References Cited

U.S. PATENT DOCUMENTS

| | | | |
|---|---|---|---|
| 1,288,197 | 12/1918 | Reynolds . | |
| 1,342,136 | 6/1920 | Smith | 248/441.1 X |
| 1,483,051 | 2/1924 | Saunders | 248/441.1 |
| 1,660,169 | 2/1928 | Knell | 248/441.1 |
| 1,660,205 | 2/1928 | Niemi . | |
| 2,234,086 | 3/1941 | Rosebrough | 248/441.1 X |
| 2,528,684 | 11/1950 | Brockman . | |
| 3,637,172 | 1/1972 | Diesbach . | |
| 4,300,743 | 11/1981 | Morris | 248/441.1 |
| 4,312,490 | 1/1982 | Biasini | 248/441.1 X |
| 4,372,518 | 2/1983 | Biasini . | |
| 4,606,525 | 8/1986 | Lombardi . | |
| 4,610,417 | 9/1986 | Kuss . | |
| 4,754,945 | 7/1988 | Diamond . | |
| 5,037,057 | 8/1991 | Andrews . | |
| 5,199,680 | 4/1993 | Rivera | 248/441.1 |
| 5,413,305 | 5/1995 | Leeb | 248/459 X |

*Primary Examiner*—Creighton Smith
*Assistant Examiner*—W. Glenn Edwards
*Attorney, Agent, or Firm*—Limbach & Limbach L.L.P.

[57] ABSTRACT

A collapsible music stand with optional multiple desks having dual-angular and vertical adjustability is provided. A music stand includes a height adjustment mechanism comprising a guide wire which frictionally engages a groove rendering the mechanism one with continuous height and frictional force adjustability. A music stand further includes a plurality of arrangements of single and multiple desks, dowels with tapered ends for ensuring the firm coupling of its components, a optional tray with a further optional candelabra, an optional bracket for coupling a lamp to the stand, pivotably adjustable tabs to accommodate wide pieces of sheet music, and detachable legs facilitating portability. A versatile music stand can be adjusted to support music at a variety of angles and is configurable as a larger and more stable conductor's stand, or to hold a musical instrument, or as a lectern. A durable and high-quality music stand includes a desk manufactured using a bookmatching method.

42 Claims, 16 Drawing Sheets

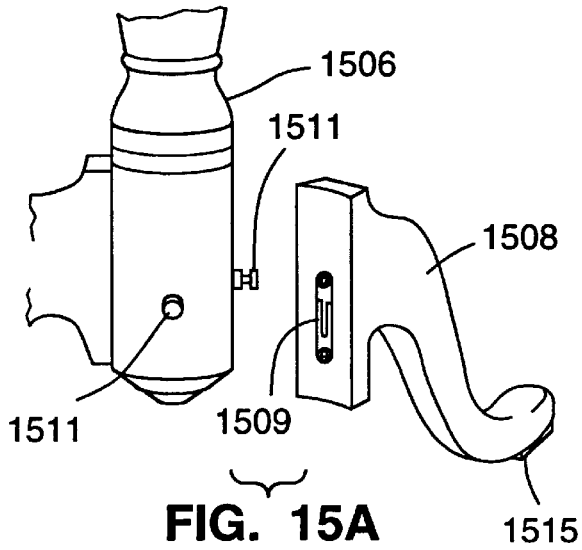
FIG. 15A
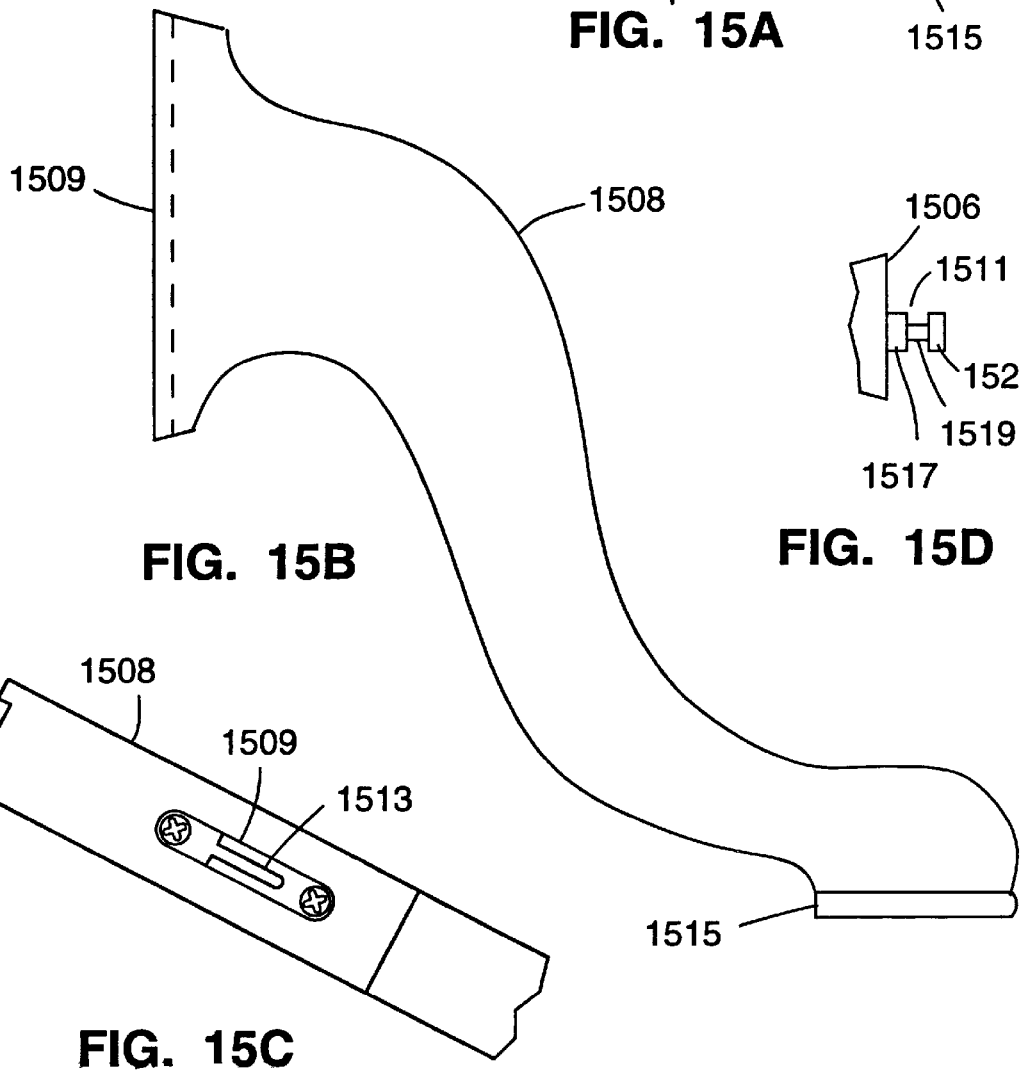
FIG. 15B
FIG. 15D
FIG. 15C

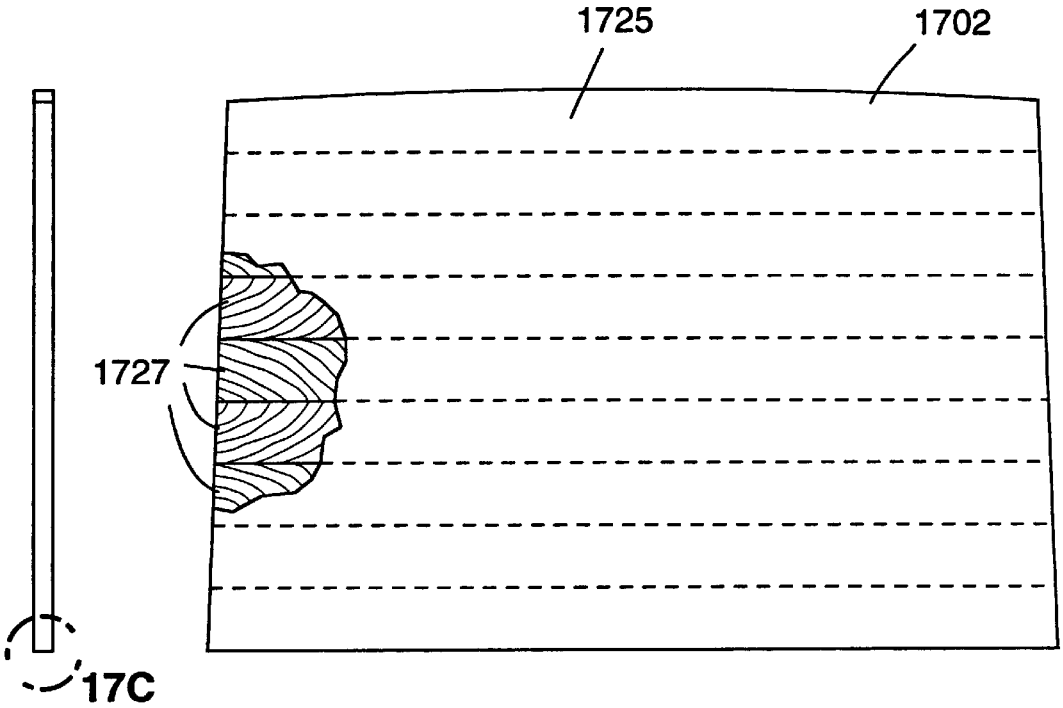
FIG. 17B
FIG. 17A
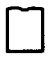
FIG. 17C
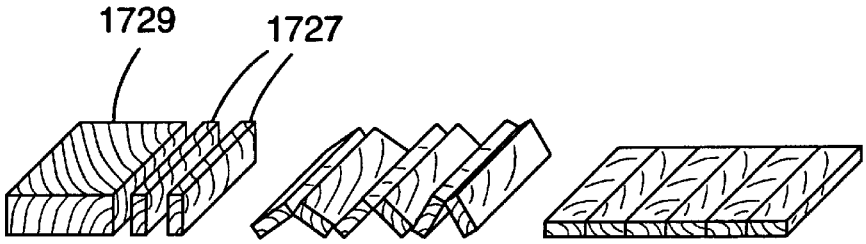
FIG. 17D FIG. 17E FIG. 17F

COLLAPSIBLE MUSIC STAND WITH OPTIONAL MULTIPLE DESKS HAVING DUAL-ANGULAR AND VERTICLE ADJUSTABILITY

BACKGROUND OF THE INVENTION

1. Field of Invention

The present invention relates generally to music stands, and, more particularly, to collapsible music stands with optional multiple desks having dual-angular and vertical adjustability.

2. Background

Music stands have been in use for many years. Music stands serve to support sheet music at eye level, freeing the hands of the musician to perform the musical work thereon. FIG. 1 shows a music stand 100 with conventional features. As will be discussed later, a music stand in accordance with the present invention comprises conventional features of the music stand of FIG. 1. Referring to FIG. 1, a conventional music stand 100 comprises a desk 102, a dowel 104, a mechanism for coupling the desk and the dowel (not shown), a spindle 106 engaging the dowel 104 below the attachment to the desk 102 to the dowel 104, and a plurality of legs 108 engaging the spindle 106 and supporting the conventional music stand 100. A conventional music stand 100 may include a mechanism for height adjustment 110 and a mechanism or mechanisms for angular adjustability of the desk (not shown).

The conventional spindle 106 has an axial cavity (not shown) which is cylindrical and open at the top of the spindle 106 for engaging a dowel 104. A conventional music stand 100 may include a mechanism for preventing vertical relative motion between the dowel 104 and the spindle 106. The outer contours of the spindle 106 may have one of a variety of shapes. Although a conventional music stand 100 is often otherwise height adjustable, a spindle 106 of a conventional music stand may come in any of a variety of lengths to provide a generally short, medium or tall music stand 100.

Legs 108 for conventional music stands 100 can come in a variety of shapes and sizes. Legs 108 for conventional music stands 100 can be attached to a conventional music stand 100 to support the conventional music stand 100 in a variety of ways. If individual legs 108 of the same music stand 100 have different specifications, or are attached to the spindle 106 in different ways, then the music stand 100 may be unstable as to wobble. Wobbling music stands are undesirable.

A dowel 104 for a conventional music stand 100 is substantially cylindrical. The diameter of the dowel 104 is optimally slightly less than the diameter of the axial cavity of the spindle 106 to which it is engaged. If the diameter of the dowel 104 is much less than the diameter of the axial cavity of the spindle 106, then support for the dowel 104 is also much less. A dowel 104 is also configured to couple with either a desk 102 or a coupling mechanism (not shown) for coupling the dowel 104 with a desk 102.

A desk 102 for a conventional music stand includes a substantially flat panel 112 which is usually on the order of the size of a piece of sheet music or larger. A panel 112 can be solid, or, can have cavities as long as the cavities are smaller than the sheet music. A conventional desk 102 includes a shelf 114 which is substantially flat and rectangular having a length substantially equal to the width of the panel 112. The shelf 114 couples with the panel 112 to form a substantially 90° corner. This combination of the panel 112 and the shelf 114 supports sheet music.

The components of a conventional music stand 100 may be manufactured from a variety of materials including metals and woods. It is desirable to have a music stand composed of material which is enduring, pleasing to the eye and versatile as to compatibility with a musical environment.

Musicians sometimes practice or perform solo, but often perform with one or more contemporaries in the form of a duet, trio, quartet, etc. Within such an ensemble, each musician usually reads from a different piece of sheet music. It is desirable to have a music stand that is versatile in accommodating ensembles of varying numbers of musicians.

Moreover, musical ensembles often practice or perform in limited spaces. It is therefore desirable to have a music stand that can accommodate entire ensembles while compromising a minimal amount of space.

What's more, musicians often travel to designated places to practice or perform, such as music halls, studios or other musicians' homes or studios. It is useful, therefore, for a musician or an ensemble of musicians to have a music stand which is portable.

Furthermore, every musician is unique in the sense of the optimal positioning of the sheet music that the musician is reading from. Optimal positioning may also depend on the particular musical instrument that the musician is playing, as well as many other factors. Therefore, it is desirable to have a music stand that is adjustable as to the height and angle at which it supports sheet music.

SUMMARY OF THE INVENTION

A music stand in accordance with the present invention includes a height adjustment mechanism comprising a guide wire which frictionally engages a groove rendering the mechanism one with continuous height and frictional force adjustability.

A music stand in accordance with the present invention is optionally configurable into a plurality of arrangements of single and multiple desks.

A music stand in accordance with the present invention includes dowels with tapered ends for ensuring the firm coupling of its components.

A music stand in accordance with the present invention optionally includes a tray with a further optional candelabra.

A music stand in accordance with the present invention optionally comprises a bracket for coupling a lamp to the stand.

A music stand in accordance with the present invention is adjustable to support music at a variety of angles.

A music stand in accordance with the present invention includes pivotably adjustable tabs to accommodate wide pieces of sheet music.

A music stand in accordance with the present invention includes detachable legs facilitating portability.

A music stand in accordance with the present invention is configurable as a larger and more stable unit, such as one that a conductor might utilize.

A music stand in accordance with the present invention includes a desk which is manufactured using a bookmatching method which enhances it quality and durability.

A music stand in accordance with the present invention is configurable to hold a musical instrument.

A music stand in accordance with the present invention is configurable as a lectern.

A better understanding of the features and advantages of the invention will be obtained by reference to the following detailed description and accompanying drawings which set forth an illustrative embodiment in which the principles of the invention are utilized.

BRIEF DESCRIPTION OF THE DRAWINGS

FIG. 15A is a perspective view of the coupling mechanism for detachable legs of the music stand.

FIG. 15B is a side elevational view of the leg shown in FIG. 15A.

FIG. 15C is an end elevational view of the left hand end of the leg shown in FIG. 15B.

FIG. 15D is an enlarged view of a portion of the attachment structure shown in FIG. 15A.

FIG. 17A is an elevational view of a bookmatched desk with a portion showing the grain of the wood.

FIG. 17B is a side elevational view of the structure shown in FIG. 17A.

FIG. 17C is an enlarged view of the portion C shown in FIG. 17B.

FIGS. 17D–17F are perspective views showing how the wood strips are cut and arranged in planar manner.

DETAILED DESCRIPTION

Figure 1:
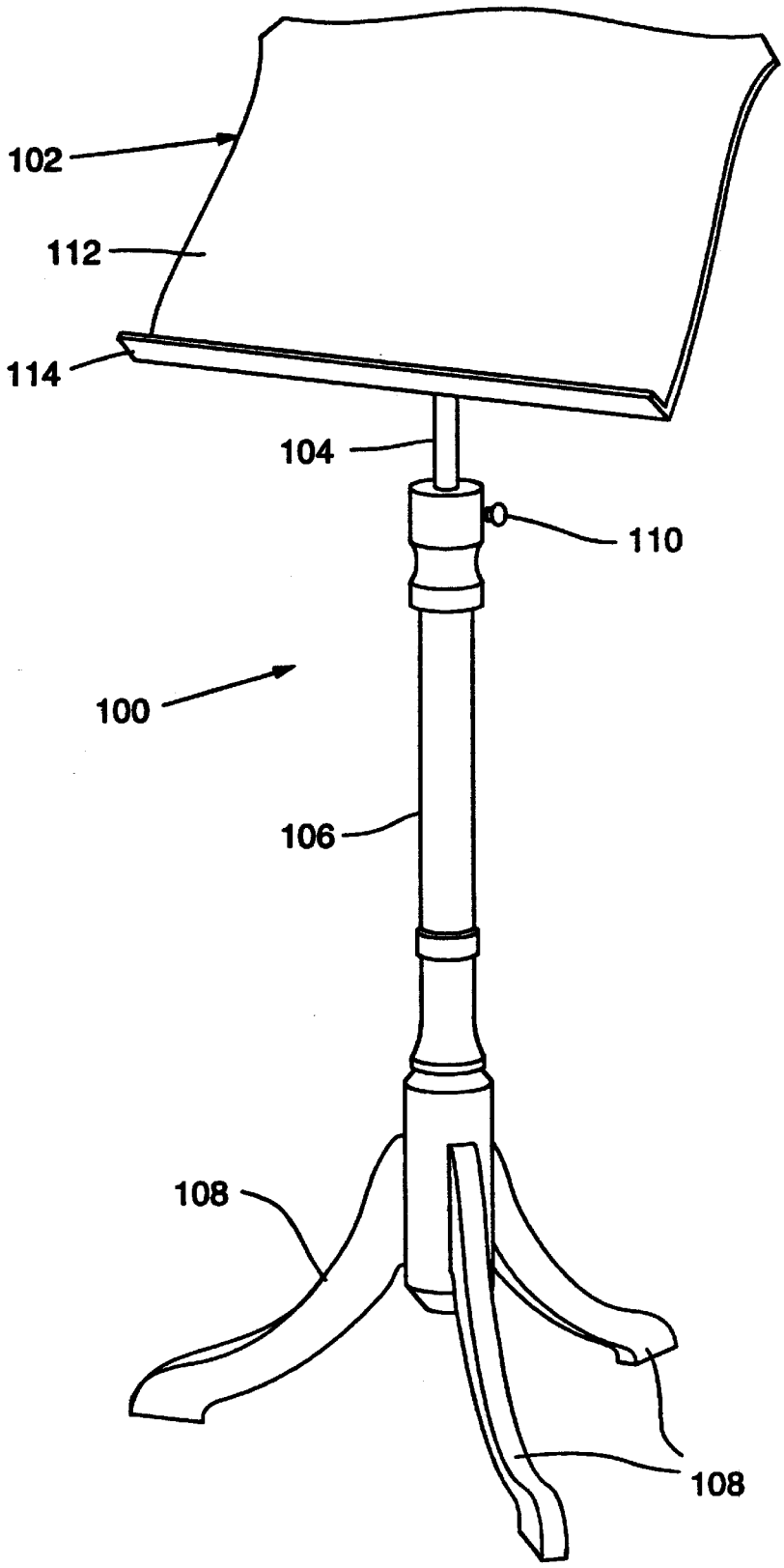
FIG. 1 shows a music stand with conventional features.

The music stand in accordance with the present invention includes the general features described above with respect to FIG. 1 with numerous improvements in many aspects of the music stand which enhance its appearance, operation, adjustability, disassembility and modification to serve multiple users and for multiple purposes.

FIGS. 2A–2E shows a height adjustment mechanism 200 for a music stand in accordance with the preferred embodiment of the present invention. Referring to FIGS. 2A–2E, the music stand of the present invention includes a desk (not shown), a dowel 204 coupled with the desk, a height adjustment mechanism 200, a spindle 206 engaging the dowel 204 below its attachment to the desk, and a plurality of legs (not shown) engaging the spindle 206 and supporting the music stand.

The height adjustment mechanism comprises a guide wire 216, a threaded insert 218 and a dual-threaded screw 220. The threaded insert 218 is embedded in the spindle 206 and the dual-threaded screw 220 engages the threaded insert 218. The guide wire 216 is coupled to the spindle 206 and extends into a cylindrical cavity 222 of the spindle 206. The dual-threaded screw 220 engages the guide wire 216 such that the radial position of the dual-threaded screw 220 determines the radial position of the guide wire 216 with respect to the axis of cylindrical symmetry of the cylindrical cavity 222 into which the guide wire 216 extends.

Figure 2A:
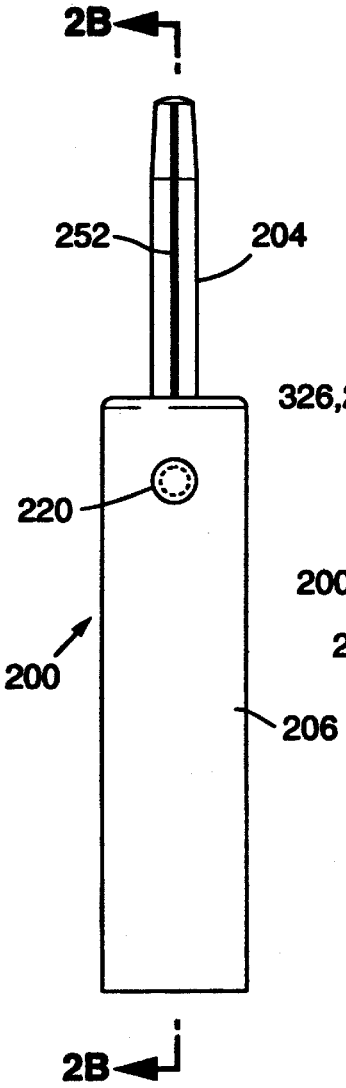
FIG. 2A is an elevational view of the spindle and dowel with a height adjustment mechanism for a music stand in accordance with the present invention.
Figure 2B:
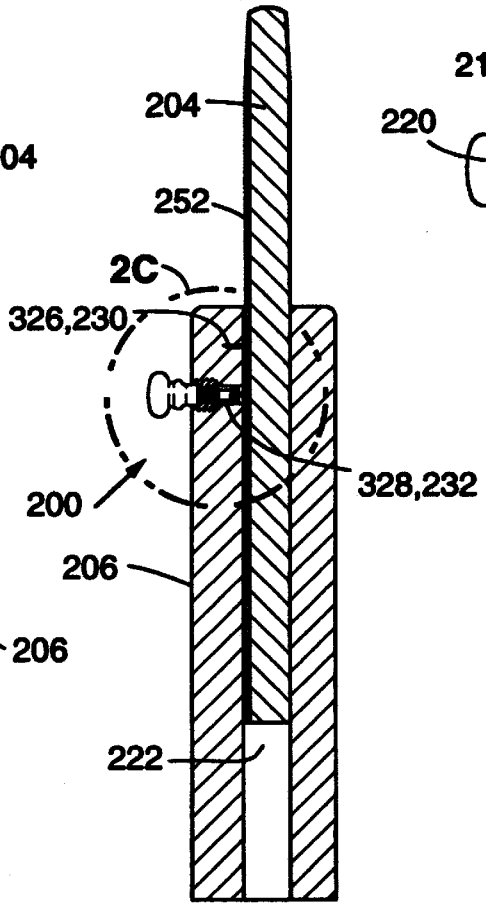
FIG. 2B is a cross-sectional view of the structure shown in FIG. 2A taken along line BB in the direction of the arrows.
Figure 2C:
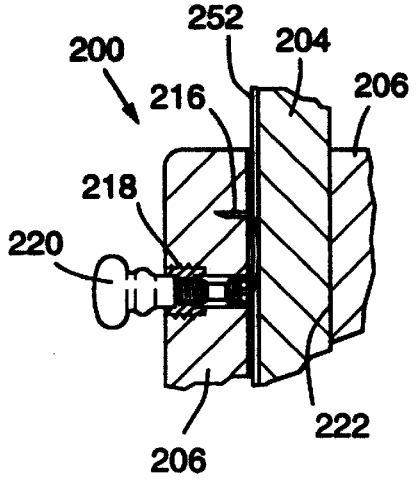
FIG. 2C is an enlarged view of the portion designated C of the structure shown in FIG. 2B.
Figure 2E:
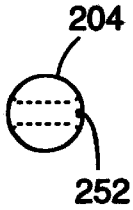
FIG. 2E is an end view of the left hand end of the dowel shown in FIG. 2D.
Figure 2D:
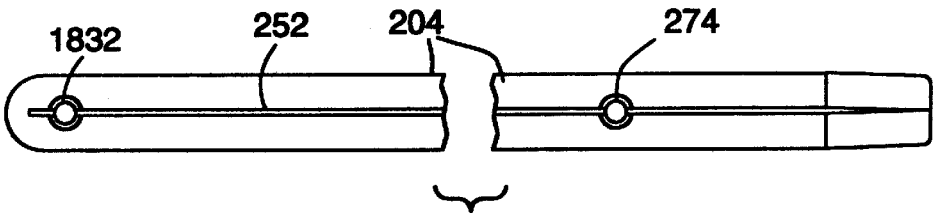
FIG. 2D is a foreshortened elevational view of the dowel shown in FIGS. 2A and 2B.
Figure 3:
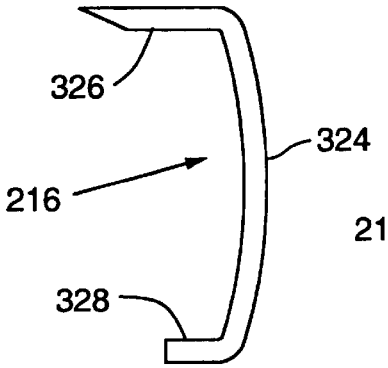
FIG. 3 shows a guide wire for the height adjustment mechanism of FIG. 2A.
Figure 4A:
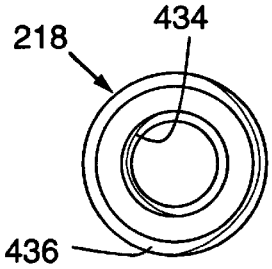
FIG. 4A is an end view of a threaded insert for the height adjustment mechanism of FIGS. 2A–2E.
Figure 4C:
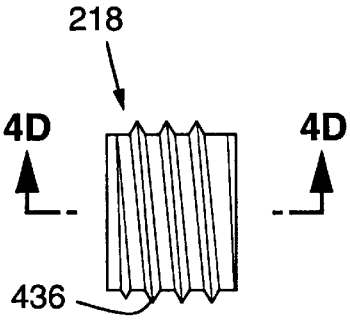
FIG. 4C is a side elevational view of the threaded insert.
Figure 4B:
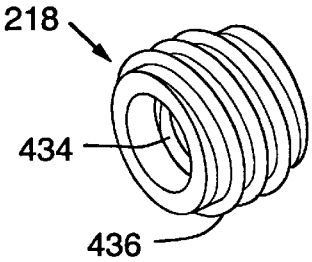
FIG. 4B is a perspective view of the threaded insert.
Figure 4D:
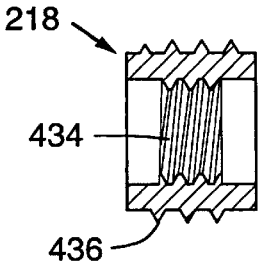
FIG. 4D is a cross-sectional view of the threaded insert taken along line DD of FIG. 4C in the direction of the arrows.

FIG. 3 shows a detailed illustration of the guide wire 216 of FIG. 2. Referring to FIG. 3, the guide wire 216 is U-shaped in the sense that it has a central segment 324, a first prong 326 and a second prong 328. The first prong 326 is pressed into the spindle 206 or couples with a first transverse cavity 230*?? of the spindle 206. The first prong 326 is substantially cylindrical from its connection with the central segment 324 to a point at which it begins to taper to a sharp point.

In a preferred embodiment, the guide wire 216 is comprised of 24 gauge hard stainless wire. The length of the first prong 326 is 0.3125" from its connection with the central segment 324 to the tip of the pointed end of the first prong. The taper of the first prong 326 is at a substantially 25° angle with respect to the axis of cylindrical symmetry of the cylindrical portion of the first prong 326. The first prong 326 is then substantially cylindrical for substantially 0.2215" and then tapers for an additional substantially 0.91" to a sharp point. The first transverse cavity with which the first prong 326 integrally engages is transverse with and open to a spindle 206 axial cavity 222 which is coaxial with the axis of cylindrical symmetry of the spindle 206 and which accommodates a dowel 204.

The second prong 328 of the guide wire 216 is substantially cylindrical and in a preferred embodiment has a length in a range from 0.120" to 0.180." The axis of cylindrical symmetry of the second prong 328 of the guide wire 216 which is coaxial with a second transverse cavity 232 of the spindle 206. The second transverse cavity 232 of the spindle 206 is transverse with and open to the axial cavity 222 of the spindle 206 which accommodates the dowel 204.

The central segment 324 of the guide wire 216 is arched, and, in a preferred embodiment, has a chord height of substantially 0.052" and a chord diameter of substantially 0.8." The central segment 324 of the guide wire 216 frictionally engages the dowel 204. The frictional engagement of the dowel 204 with the central segment 324 of the guide wire 216 hinders or prevents the relative motion of the dowel 204 with respect to the spindle 206.

FIGS. 4A–4D shows a detailed illustration of the threaded insert 218 of FIGS. 2A–2E. Referring to FIGS. 4A–4D, the threaded insert 218 has internal threads 434 and external threads 436. The external threads 436 facilitate coupling of the threaded insert 218 with the spindle 206. The threaded insert 218 is embedded into the spindle 206 such that the axis of cylindrical symmetry of the threaded insert 206 is coaxial with the axis of cylindrical symmetry of the second prong 328 of the guide wire 216 and is transverse with the axis of cylindrical symmetry of the spindle 206. The internal threads 434 of the threaded insert are configured for engagement with the dual-threaded screw 220.

In a preferred embodiment, the external threads 436 of the threaded insert 218 are custom sharp and the outer diameter of the threaded insert 218 between the tops of the external threads 436 is substantially 0.4375" and that between the bottoms of the external threads 436 is substantially 0.375." The length of the threaded insert 218 is less than the thickness of the cylindrical shell of the spindle 206, which is approximately 0.675," and in a preferred embodiment the length of the threaded insert 218 is substantially 0.2." The inner diameter of the threaded insert 218 between the tops of the internal threads 434 is substantially 0.197" and that between the bottoms of the internal threads 434 is substantially 0.255." The threaded insert 218 is embedded in the spindle 206 such that one end of the threaded insert 218 is substantially 0.100" inside the outer diameter of the spindle 206 at the location of the embedded threaded insert 218.

Figure 5A:
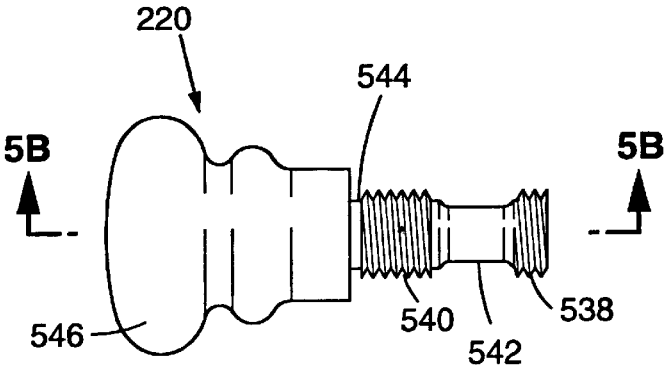
FIG. 5A is a side elevational view of a dual-threaded screw for the height adjustment mechanism of FIGS. 2A–2E.
Figure 5C:
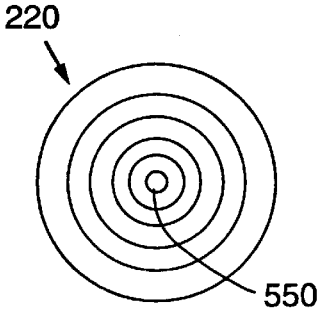
FIG. 5C is an elevational end view of the right hand end of the structure shown in FIG. 5A.
Figure 5B:
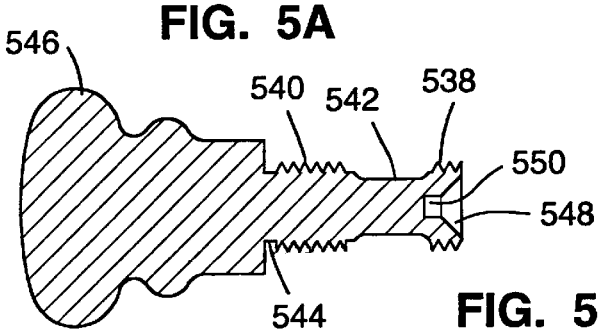
FIG. 5B is a cross-sectional view of the structure shown in FIG. 5A taken along line BB in the direction of the arrows.

FIGS. 5A–5C shows a detailed illustration of the dual-threaded screw 220 of FIGS. 2A–2E. Referring to FIGS. 5A–5C, the dual-threaded screw 220 has first threaded segment 538 and a second threaded segment 540 with an unthreaded segment therebetween 542. The diameters of the threads of the first threaded segment 538 and second threaded segment 540 of the dual-threaded screw 220 accommodate coupling with the threaded insert 218 of FIGS. 4A–4D. In a preferred embodiment, the first threaded segment 538 of the dual-threaded screw is 0.100" long and has a diameter less than 0.255" between the tops of its threads and has a diameter less than 0.197" between the bottoms of its threads. The unthreaded segment 542 is substantially cylindrical and substantially 0.180" long and has a diameter of substantially 0.155." The second threaded segment 540 of the dual-threaded screw 220 is substantially 0.25" long. A thread relief segment 544 of substantially 0.031" is adjacent to the second threaded segment 540.

The head 546 of the dual-threaded screw 220 is wider in diameter than the threaded segments and is substantially 0.71" long. The second threaded segment 540 of the dual-threaded screw 220 engages the threaded insert 220. The end 548 of the dual-threaded screw 220 has a cylindrical end cavity 550 which engages the second prong 328 of the guide wire 216 such that the second prong 328 of the guide wire 216 and the end cavity 550 of the dual-threaded screw 220 are coaxial and the second prong 328 internally engages the end cavity 550.

A spindle in accordance with the preferred embodiment of the present invention in FIGS. 2A–2E has a first transverse cavity 230 and a second transverse cavity 232. The first transverse cavity 230 is a small cylindrical hole transverse with and open to the axial cavity 222 of the spindle 206 and located a short distance down from the top of the spindle 206. The second transverse cavity 232 has two cylindrical sections of different diameters and is located approximately the length of the central segment 324 of the guide wire 216 down from the first transverse cavity 230. The larger diameter section opens to the outside of the spindle 206 and is substantially 0.40625" in diameter.

The larger diameter section extends substantially 0.4" into the spindle 206 from the outer diameter of the spindle 206. The smaller diameter section opens to the axial cavity 222 of the spindle 206 and is substantially 0.28125" in diameter. The smaller diameter section extends substantially 0.275" into the spindle 206 from the inner diameter of the spindle 206 to join the larger diameter section, such that the thickness of the spindle 206 at the location of the embedded threaded insert 218 is substantially 0.675" from the radius of the axial cavity 222 of the spindle 206 to the outer radius of the spindle 206.

The dowel 204 in accordance with the preferred embodiment of the present invention, FIGS. 2A–2E, has a groove 252 running down a portion of the length of the dowel 204.

The groove 252 is wide enough to accommodate the central segment 324 of the guide wire 216 which fits into the groove 252. The dowel 204 and the groove 252 are preferably long enough to accommodate as great a range of accessible heights as possible.

Figure 7:
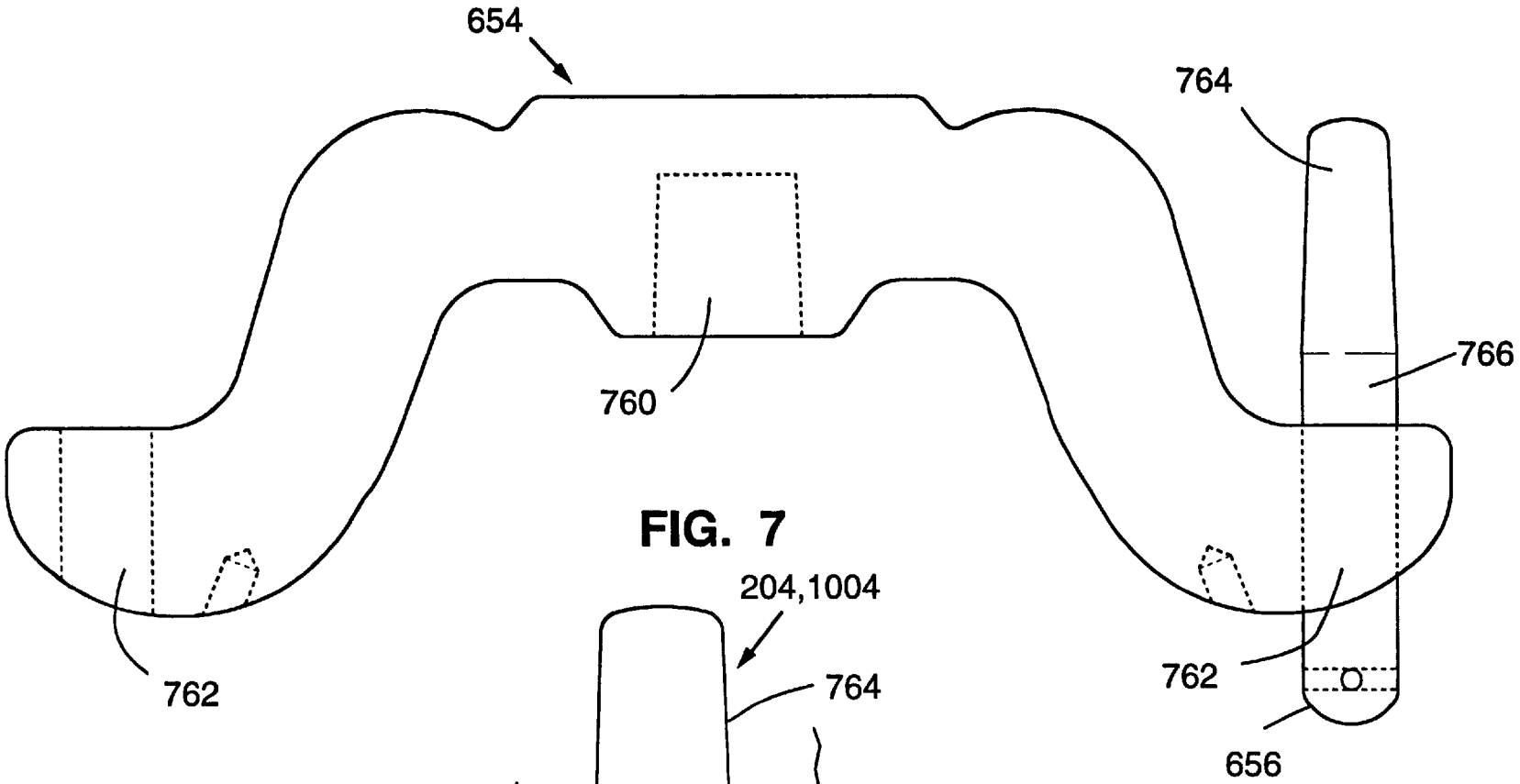
FIG. 7 shows a yoke for a music stand as depicted in FIGS. 6A–6B and 8A–9B respectively.
Figure 10:
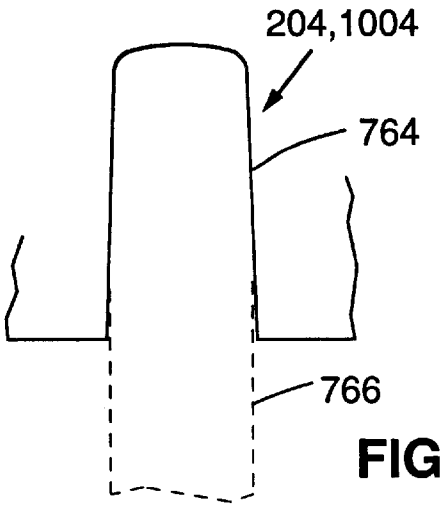
FIG. 10 shows a dowel with a tapered end for a music stand in accordance with the present invention.
Figure 12A:
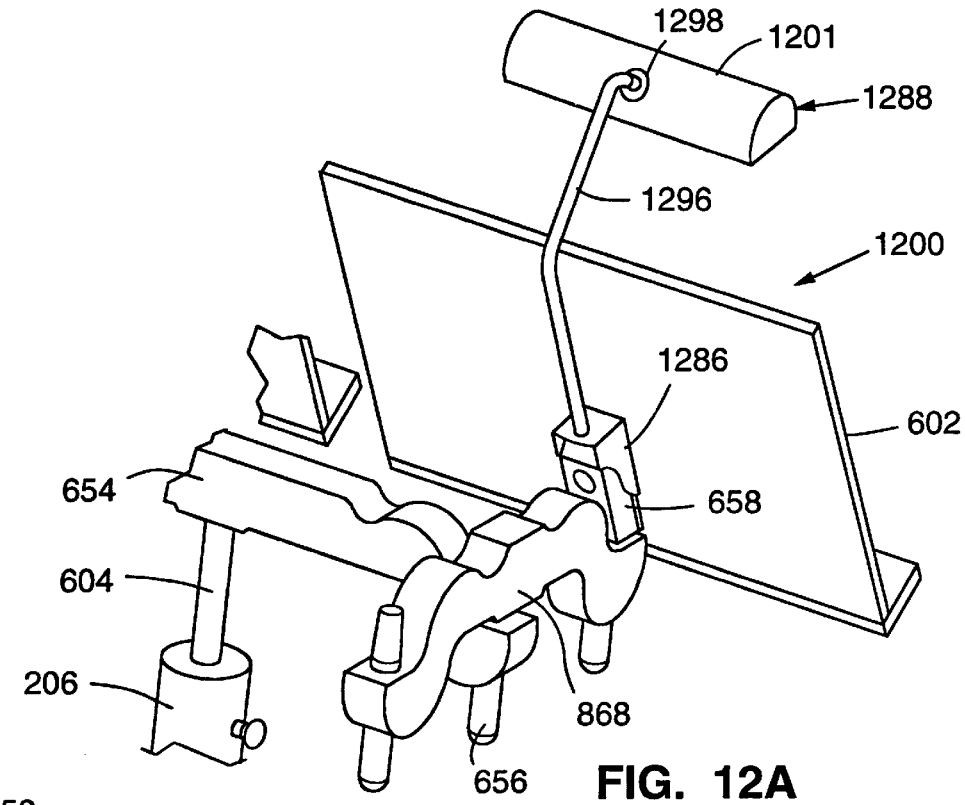
FIG. 12A is a perspective view of a music stand having a bracket for mounting a lamp.
Figure 12B:
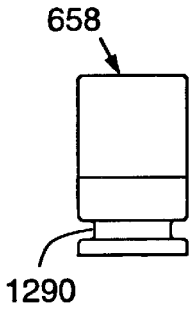
FIG. 12B is an end view of the tilt block.
Figure 12C:
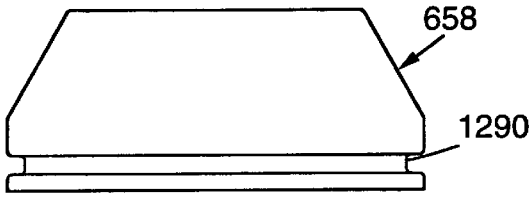
FIG. 12C is a side view of the tilt block.
Figure 12F:
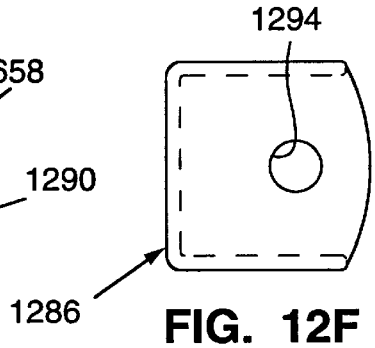
FIG. 12F is an end view of the top end of the structure shown in FIG. 12D.
Figure 12D:
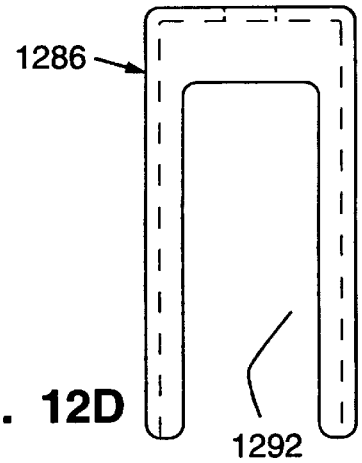
FIG. 12D is a plan view of the lamp bracket.
Figure 12E:
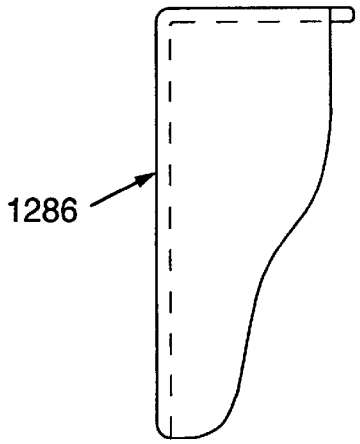
FIG. 12E is a right hand side view of the structure shown in FIG. 12D.
Figure 13A:
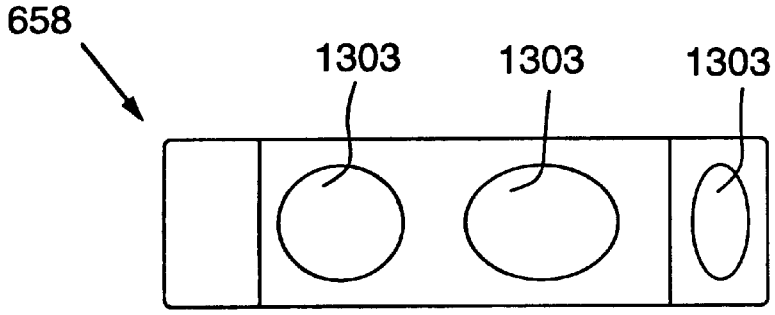
FIG. 13A is a top view of the tilt block.
Figure 13B:
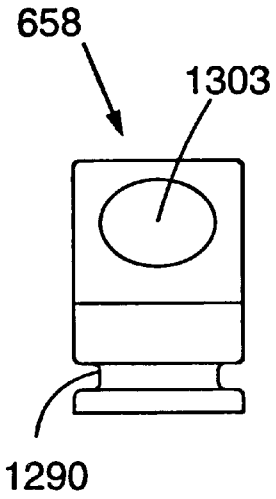
FIG. 13B is an end view of the right hand end of a tilt block for the music stand.
Figure 13C:
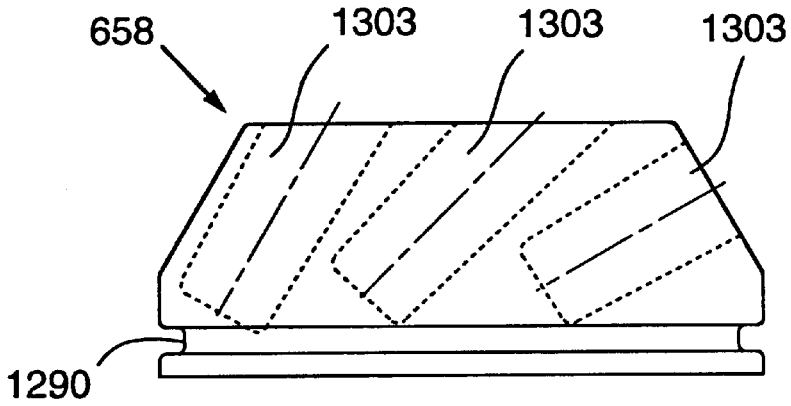
FIG. 13C is a side elevational view of the left hand side of the tilt block shown in FIG. 13B.
Figure 14A:
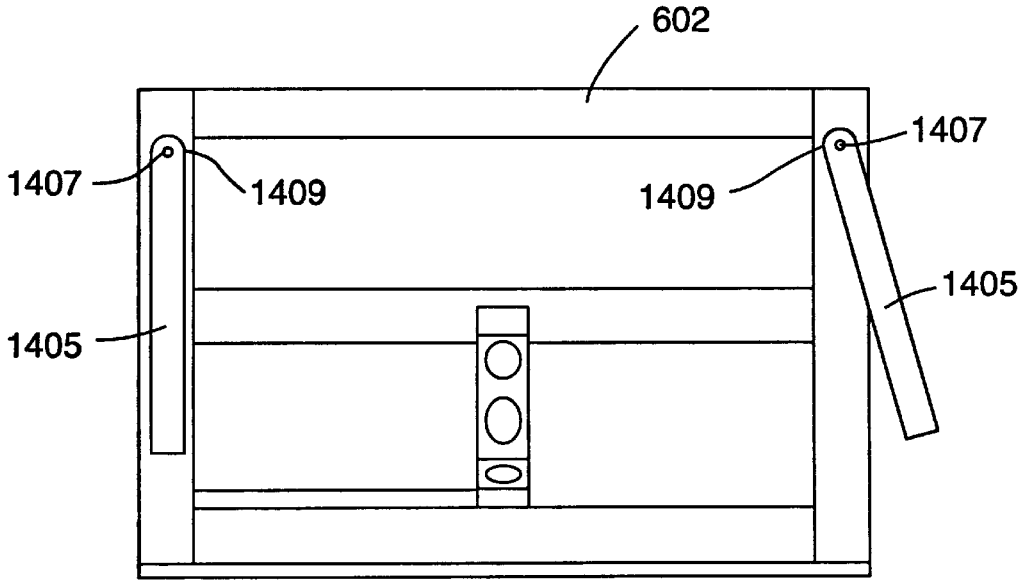
FIG. 14A is an elevational view of a desk showing a extender tabs for the music stand.
Figure 14B:
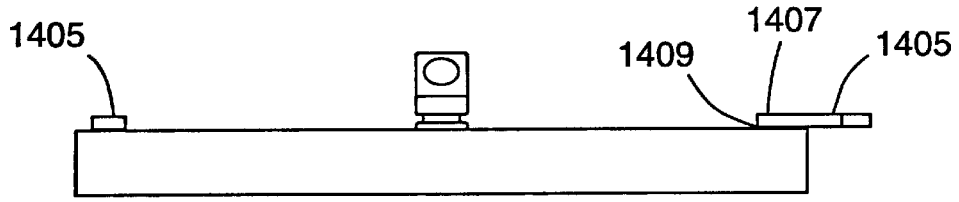
FIG. 14B is a top view of the structure shown in FIG. 14A.
Figure 14C:
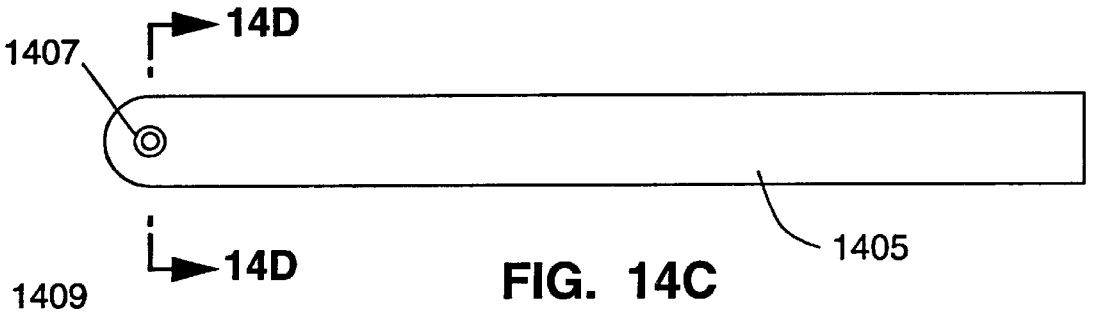
FIG. 14C is a plan view of an extender tab.
Figure 14D:
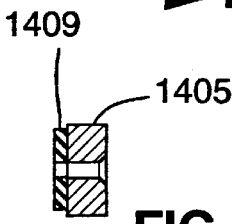
FIG. 14D is a cross-sectional view of a portion of the structure shown in FIG. 14C taken along line DD in the direction of the arrows.

FIG. 10 shows the dowel 204 with a tapered end 764 in accordance with the preferred embodiment of the present invention. Referring to FIG. 10, the dowel 204 includes a tapered end 764 which is tapered at a substantially two degree angle with respect to the axis of cylindrical symmetry of the dowel 204. The length of the dowel 204 is variable. For example, a primary dowel 204 may be longer than any secondary dowel 204 for accommodating height adjustment. The untapered part 766 of the dowel 204 is substantially right cylindrical having a base radius. Preferably the base radius is 0.388." The tapered end 764 preferably extends for 1.25" to 1.5" in length. The tapered end 764 of each dowel 204 constitutes the male half of a coupling pair including either a tilt block 658 which is coupled to a desk 602 or various yokes for coupling to multiple desks. A tilt block 658 as shown in FIGS. 13A–13C or yokes 654,868 as shown in FIGS. 7 and 12A, respectively, which couple to the tapered end 764 of a dowel 204 have cavities which are configured to fit the contours of the tapered end 764 of the dowel 204. It has been discovered that the two degree tapered end provides the best, strong releasable fit between the dowel 204 and associated tilt block and/or yokes.

FIGS. 13A–13C shows a tilt block 658 in accordance with the preferred embodiment of the present invention. Referring to FIG. 13, the tilt block 658 has at least one cavity 1303 for coupling with the dowel 204. Preferably, the tilt block 658 has three cavities 1303. Each cavity 1303 is configured to fit a dowel 204. In a preferred embodiment, each cavity 203 is configured to fit a tapered dowel 1004 such as that shown in FIG. 10. Each cavity 1303 has a different pitch and a desk 602 attached to the tilt block 658 will be angled according to the pitch of the cavity 1303 used.

In the preferred embodiment, the tilt block 658 has a cavity 1303 with a thirty degree pitch, a cavity 1303 with a forty-five degree pitch and a cavity 1303 with a sixty degree pitch. Each pitch is an angle between the axis of cylindrical symmetry of the cavity 1303 and a perpendicular to the plane of the desk 602. Since the dowel 204 is coaxial with the axis of symmetry of the cavity 1303 with which it is engaged, and each dowel 204 is substantially vertical, the desk 602 is angled at the pitch of the cavity 1303 engaged by the dowel 204.

In the simplest embodiment of the present invention, the music stand has a single desk but with the features of the preferred embodiment the music stand can be simply and easily modified to accommodate multiple desks in a variety of positions.

The adjustment mechanism 200 provides many advantages. The use of the guide wire in the groove of the dowel provides extended length of contact between the dowel and the wire for providing the friction to prevent relative motion between those two elements. Additionally, the adjustment mechanism does not exhibit any visible depressions on the outside surface of the dowel that would be produced by a screw element engaging the outside surface of the dowel. This is especially important when, as preferred, the music stand is made of wood.

The first and second threaded segments 538 and 540, respectively, separated by the unthreaded segment 542 provide a safety feature whereby the clamping action between the spindle and the dowel can be completely removed by unscrewing the second threaded segment 540 past the threads 434 of insert 218 such as for disassembly and carrying between locations and still preventing the loss of the threaded screw 220.

Figure 6A:
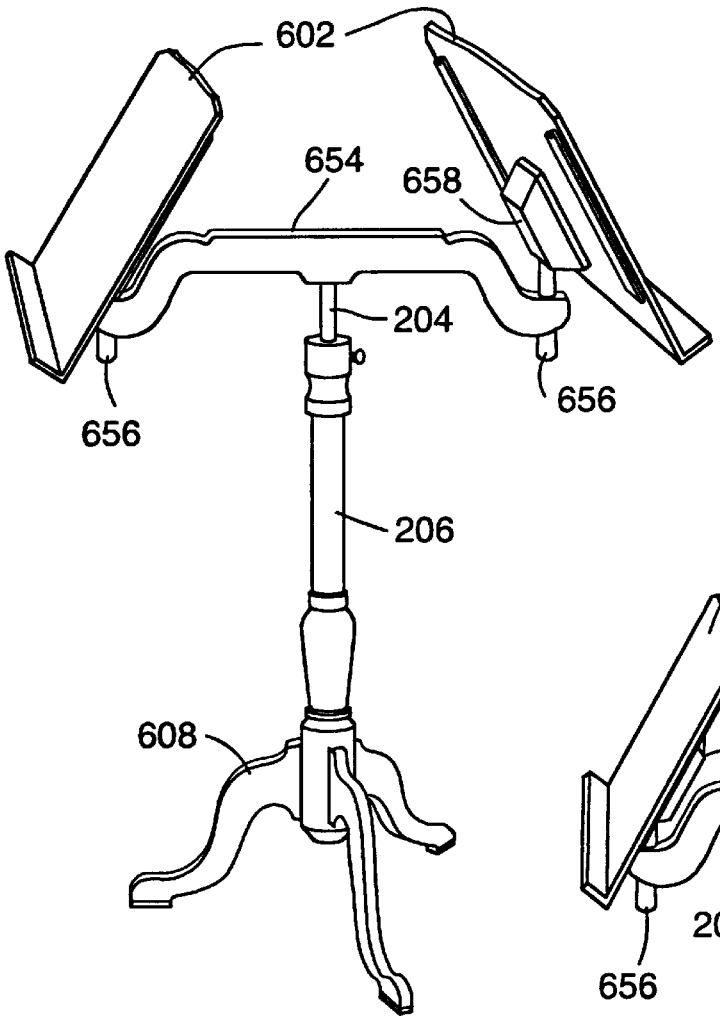
FIG. 6A shows a music stand having two desks with a long yoke.
Figure 6B:
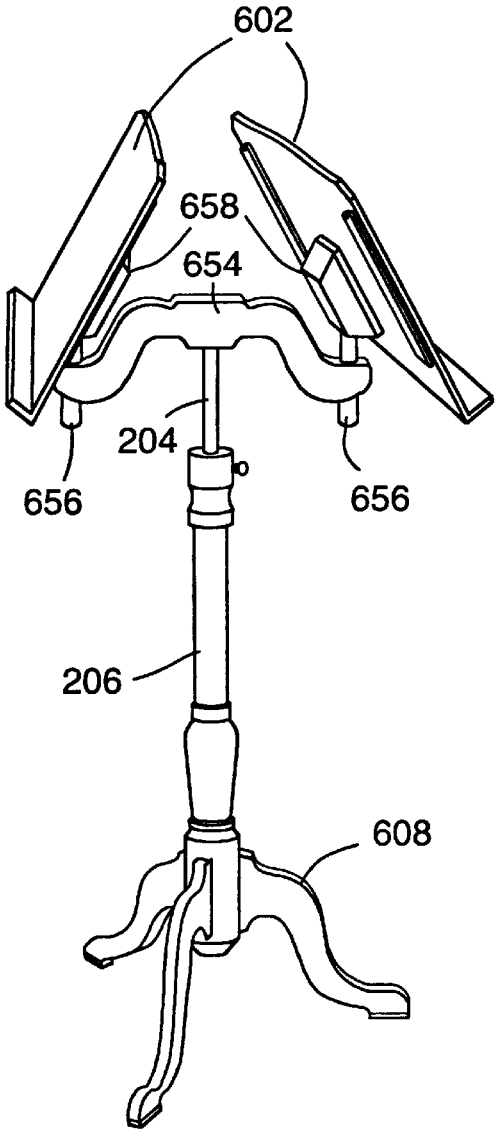
FIG. 6B shows the music stand with a shorter yoke.

FIGS. 6A–16B shows a music stand having two desks 602. Referring to FIGS. 6A–6B, the spindle 206 is coupled with a plurality of legs 608 and a primary dowel 204. The primary dowel 204 is coupled with a yoke 654 (the primary yoke) as described in FIG. 7, preferably at the center of the primary yoke 654, such that the primary yoke 654 is balanced. The primary yoke 654 couples with two secondary dowels 656.

Each secondary dowel 656 could be similar to the primary dowel 204 or may be different. For example, it is preferable to have a longer primary dowel 204 so that the height of the stand can be adjusted most efficiently. Secondary dowels 656 maintain their coupling with a yoke 654 because a screw fastens them to the yoke 654 and holds them in place relative to the yoke 654. The two secondary dowels 656 are preferably located an equal distance from the center of the yoke 654 and are similar in weight and shape, such that the music stand maintains balance.

Each secondary dowel 656 couples to a desk 602 via a tilt block 658. One tilt block 658 is coupled to the back of each desk. In the preferred embodiment, the tilt block 658 of the second embodiment exhibits similar characteristics to that shown in more detail in FIGS. 13A–13C.

Each desk 602 and each yoke 654 is free to swivel because the coupling of each tilt block 658 and yoke 654 to dowels 204,656 does not prevent relative rotational motion between the desks 602 and yokes 654 and their respective dowels 204,656. The coupling of the tilt blocks 658 and yokes 654 only prevents lateral and downward vertical motion of each desk 602 and yoke 654. Each desk 602 and yoke 654 can be removed easily by lifting the desk 602 or yoke 654 up off of the dowels 204,656 upon which it is coupled. Many configurations of the music stand are possible by rotation of the desks 602 and yokes 654, by interchanging different length yokes 654, and by adjusting the vertical position of the primary dowel 204 with respect to the spindle 206.

FIG. 7 shows a yolk 654 usable with two, three or four desks as depicted in FIGS. 6A–6B and 8A–9B. Referring to FIG. 7, a yoke 654 in accordance with the present invention has a central cavity 760 centered on the center of gravity of the yoke 654 and open to the bottom of the yoke 654. The yoke 654 also has at least one outer cavity 762 and, in the preferred embodiment, has two outer cavities 762, one at each end of the yoke 654. The central cavity 760 couples with either the primary dowel 204 or a secondary dowel 656, but in either case, is configured to firmly fit the tapered end 764, which is shown in detail in FIG. 10, of the dowel 654. The outer cavity 762 of the yoke 654 fits over the right cylindrical base 766 of a secondary dowel 656. The secondary dowel 656 is secured in place by a screw (not shown).

Figure 8A:
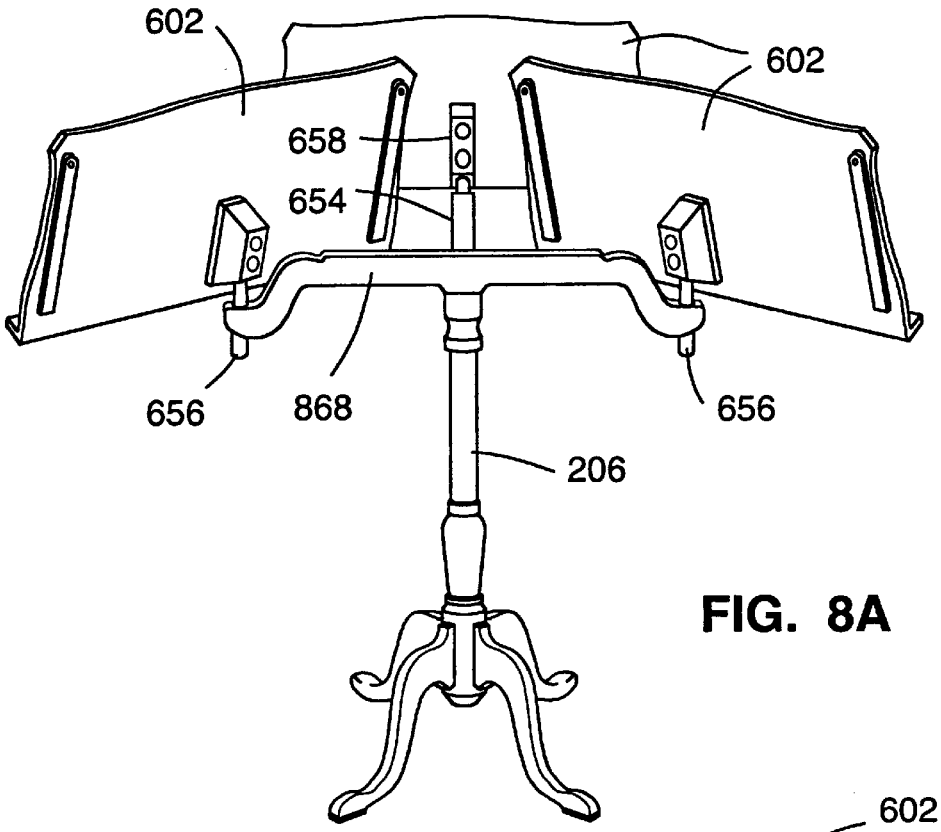
FIG. 8A is a perspective view of a music stand having three desks.
Figure 8B:
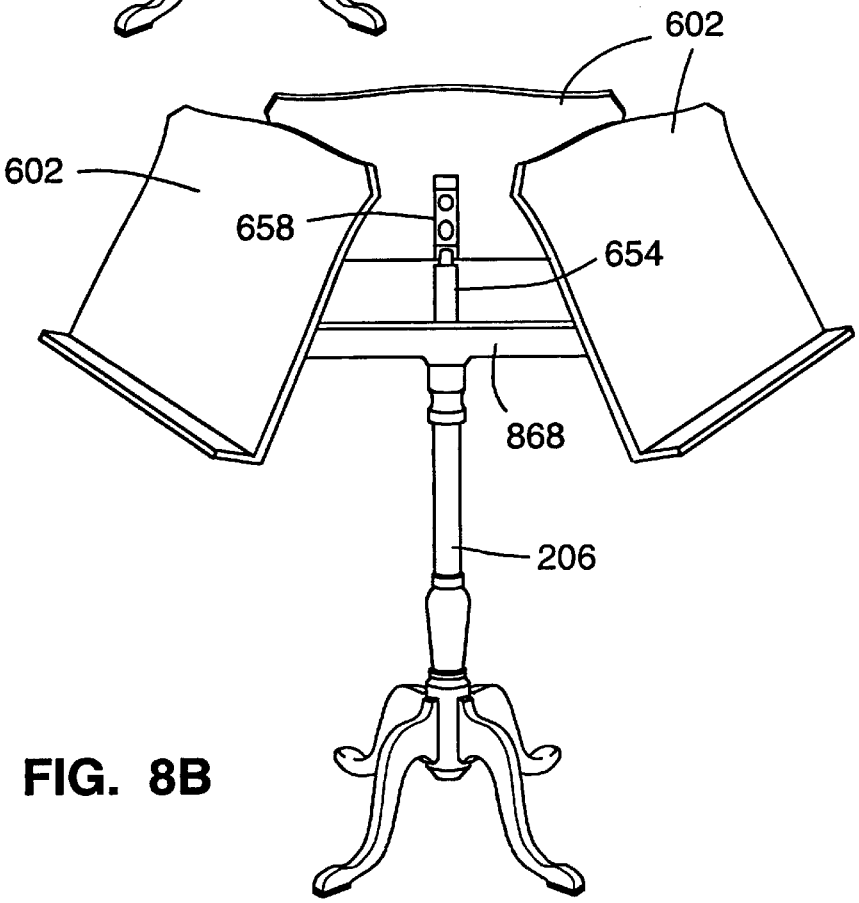
FIG. 8B is a perspective view of another three desk version.

FIGS. 8A–8B shows a music stand having three desks. Referring to FIGS. 8A–8B, a primary yoke 654 is coupled to the primary dowel 204 which is coupled with the spindle 206. Two secondary dowels 656 are coupled to the primary yoke 654. One secondary dowel 656 couples with a desk 602 via a tilt block 658 attached to the back of the desk 602. The other secondary dowel 656 couples with a second yoke 868, preferably at the center of gravity of the second yoke 868.

The length of the second yoke 868 could be the same as or different from the length of the primary yoke 654. Two secondary dowels 656 are then coupled with the second yoke 868 in a way similar to that of the secondary dowels 656 which couple with the primary yoke 654. A second desk 602 and a third desk 602 are coupled each with one of the secondary dowels 656 of the second yoke 868 via a tilt block 658, again in a way similar to that of the first desk 602. Many configurations of the music stand are possible by rotation of the desks 602 and yokes 654,868, by interchanging different length yokes 654,868, and by adjusting the vertical position of the primary dowel 204 with respect to the spindle 206.

Figure 9A:
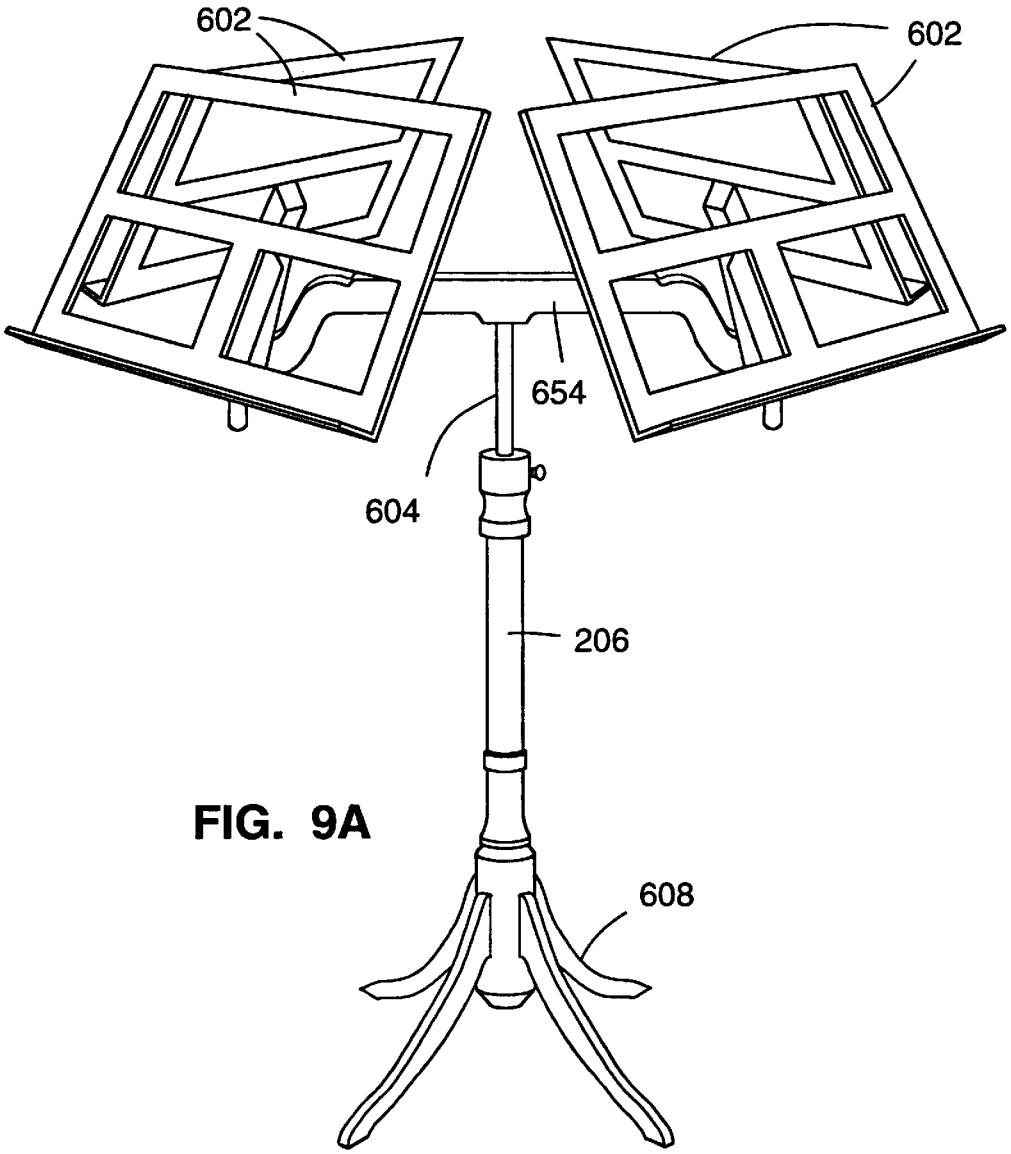
FIG. 9A shows one version of a music stand having four desks.
Figure 9B:
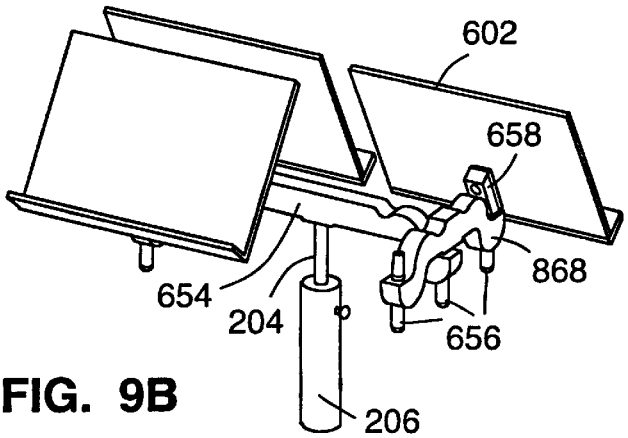
FIG. 9B shows another version having four desks.
Figure 11A:
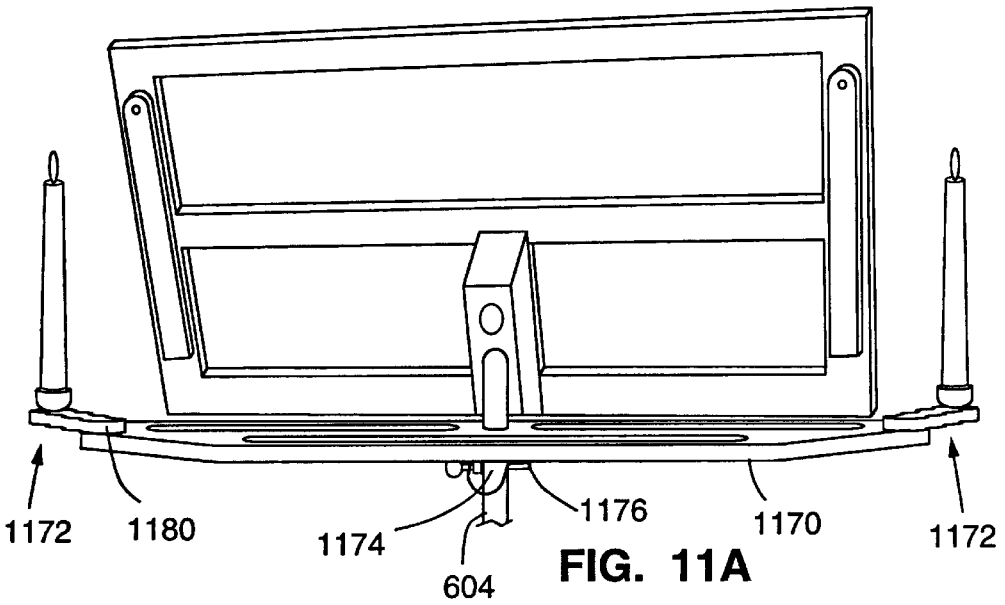
FIG. 11A is an elevational view of a tray with an optional candelabra for a music stand.
Figure 11C:
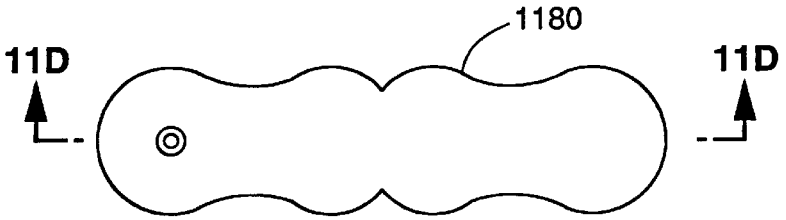
FIG. 11C is a plan view of the candle arms.
Figure 11D:
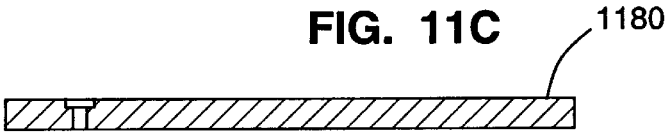
FIG. 11D is a cross-sectional view of a portion of the structure shown in 11C taken along line DD in the direction of the arrows.
Figure 11B:
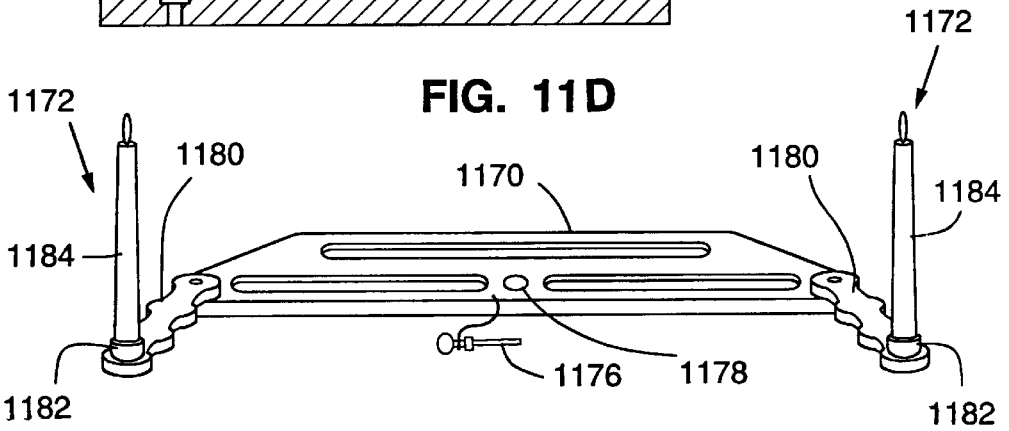
FIG. 11B is a perspective view of the tray and candelabra.

FIGS. 9A–9B shows a music stand having four desks 602. Referring to FIGS. 9A–9B, a primary yoke 654 couples with the primary dowel 204, preferably at the center of gravity of the primary yoke 654. The primary yoke 654 couples with two secondary dowels 656. One of these secondary dowels 656 couples with a second yoke 868 and the other secondary dowel 656 couples with a third yoke (not shown in FIG. 9B). The second yoke 868 and the third yoke each couple with two secondary dowels 656 and each of these secondary dowels 656 couples with a desk 602 via a tilt block 658 attached thereto.

Many configurations of the music stand are possible by rotation of the desks 602 and yokes 654,868, by interchanging different length yokes 654,868, and by adjusting the vertical position of the primary dowel 204 with respect to the spindle 206. Further, more than four desks may be attached to form a music stand in accordance with the present invention to complement a quintet, a sextet, etc., by successively iterations of attaching an additional yoke 868 and adding another desk 602.

FIGS. 11A–11D shows a music stand having a tray 1170 with an optional candelabra 1172. Referring to FIGS. 11A–11D, the tray 1170 fitted with two pencil wells is coupled preferably to the primary dowel 204, at the center of gravity of the tray 1170 in order that the tray 1170 be balanced. The tray 1170 could be coupled with a secondary dowel 656. The tray 1170 can be utilized to hold objects that need to be on hand while practicing or performing music, such as guitar picks or tuning devices.

As shown in FIG. 2D, the dowel 204 to which the tray 1170 is to be attached has a dowel cavity 274 below the tapered end 764 of the dowel 604. A pin 1176 is placed in the dowel cavity 1174 and a tray cavity 1178 in the tray 1170* allows the tray 1170 to be coupled to the dowel 204, such that the dowel 204 prevents lateral movement of the tray 1170. The tray cavity 1178 has a diameter which is substantially similar to but slightly greater than the diameter of the right cylindrical portion 766 of the dowel 204. The dowel cavity 1174 has a diameter which is substantially similar to but slightly greater than the diameter of the pin 1176.

The tray 1170 is positioned on the dowel 204 above the pin 1176 such that the pin 1176 supports the tray 1170 and prevents downward vertical movement of the tray 1170. The tray 1170 may be rotated to suit the preference of the musician and/or the situation within which it is being used. In addition, a candelabra 1172 may be attached to the tray 1170. Two candle arms 1180 are coupled to the tray 1170, preferably symmetrically, one at each end of the tray 1170. Candle holders 1182 are attached to the candle arms 1180 and candles 1184 are placed in the candle holders 1182. The candle arms are pivotably adjustable.

FIGS. 12A–12F shows a bracket 1286 for mounting a lamp 1288 on the music stand. Referring to FIGS. 12A–12F and 13A–13C, the tilt block 658 attached to the back of the desk 602 for coupling with the dowels 204,656 includes a slot 1290 located substantially close to the desk 602. Preferably, the center of the slot 1290 is 0.25" from the back plane of the desk 602 to slidably receive a lamp mounting bracket 1286. The bracket 1286 has a central notch 1292 which allows the bracket 1286 to slide into the slot 1290 in the block 658 easily and firmly. The tilt block 658 is preferably 1.0625" wide away from the slot 1290. The width of the notch 1292 is less than the width of the tilt block 658 away from the slot 1290 and is thus preferably less than 1.0625." The width of the tilt block 658 at the slot 1290 is, however, less than the width of the notch 1292 in the bracket 1286. The top of the bracket 1286 has a bracket cavity 1294 which facilitates the coupling of the lamp 1288 to the bracket 1286. The arm 1296 of the lamp 1288 is threaded on both ends. A nut couples the arm 1296 to the bracket 1286 and another nut couples the arm 1296 to the lamp socket 1298 and lamp shade 1201.

FIGS. 14A–14D shows extender tabs 1405 for the desk 602. Referring to FIG. 14, the desk 602 includes an extender tab 1405 coupled to the back of the desk 602 located near either the right side, the left side or both sides of the desk 602. An extender tab 1405 is pivotably adjustable to any angle, but is most useful between the positions of vertically downward and fully horizontally extended to adjust the effective width of the desk 602 to accommodate, if necessary, wider pieces of sheet music.

The coupling mechanism located at the pivot 1407 of each extender tab 1405 comprises a material such that the extender tab 1405 does not move in response to gravity or casual contact with other elements comprising the music stand. However, rotation about the pivot 1407 of the extender tab 1405 is possible by the willful application of torque by human contact on the extender tab 1405. Preferably, therefore, the coupling mechanism located at the pivot 1407 of each extender tab 1405 comprises a sixty durometer hardness rubber washer 1409.

FIGS. 15A–15D shows a leg 1508 and a coupling mechanism 1509 for detachable legs 1508. Referring to FIGS. 15A–15D, the music stand includes a peg 1511 configured to couple with a leg 1508 having a complementary coupling mechanism 1509. The leg 1508 comprises such a coupling mechanism in the form of a slot 1513 which runs substantially parallel with the vertical surface of the spindle 1506 when the leg 1508 is coupled with the spindle 1506. The leg 1508 further comprises a flat surface 1515 which is perpendicular to the axis of symmetry of the spindle 1506 when the leg 1508 is coupled to the spindle 1506, such that, for example, the flat surface 1515 of the leg 1508 is coplanar with a floor.

The peg 1511 has a narrow central segment 1519 and two wider outer segments 1517,1521. Preferably, each segment 1517,1519,1521 is substantially cylindrical. The central segment 1519 of the peg 1511 has a diameter which is less than the width of the slot 1513 of the leg 1508. The two wider outer segments 1517,1521 of the peg 1511 have diameters which are greater than the width of the slot 1513 of the leg 1508. When the spindle 1506 is coupled to the leg 1508 via the coupling mechanism just described, the spindle 1506 must be affirmatively lifted up to slide the peg 1511 out of the slot 1513 to decouple the spindle 1506 from the leg 1508.

Each leg 1508 exerts a torque and an inward radial force on the spindle 1506. Each of these forces and torques are balanced by counter-torques and forces from one or more of the other legs 1508. Preferably, the angular spacings between adjacent legs 1508 coupled to the spindle 1506 are equal so that each leg 1508 exerts and absorbs a substantially equal amount of force and torque.

Figure 16:
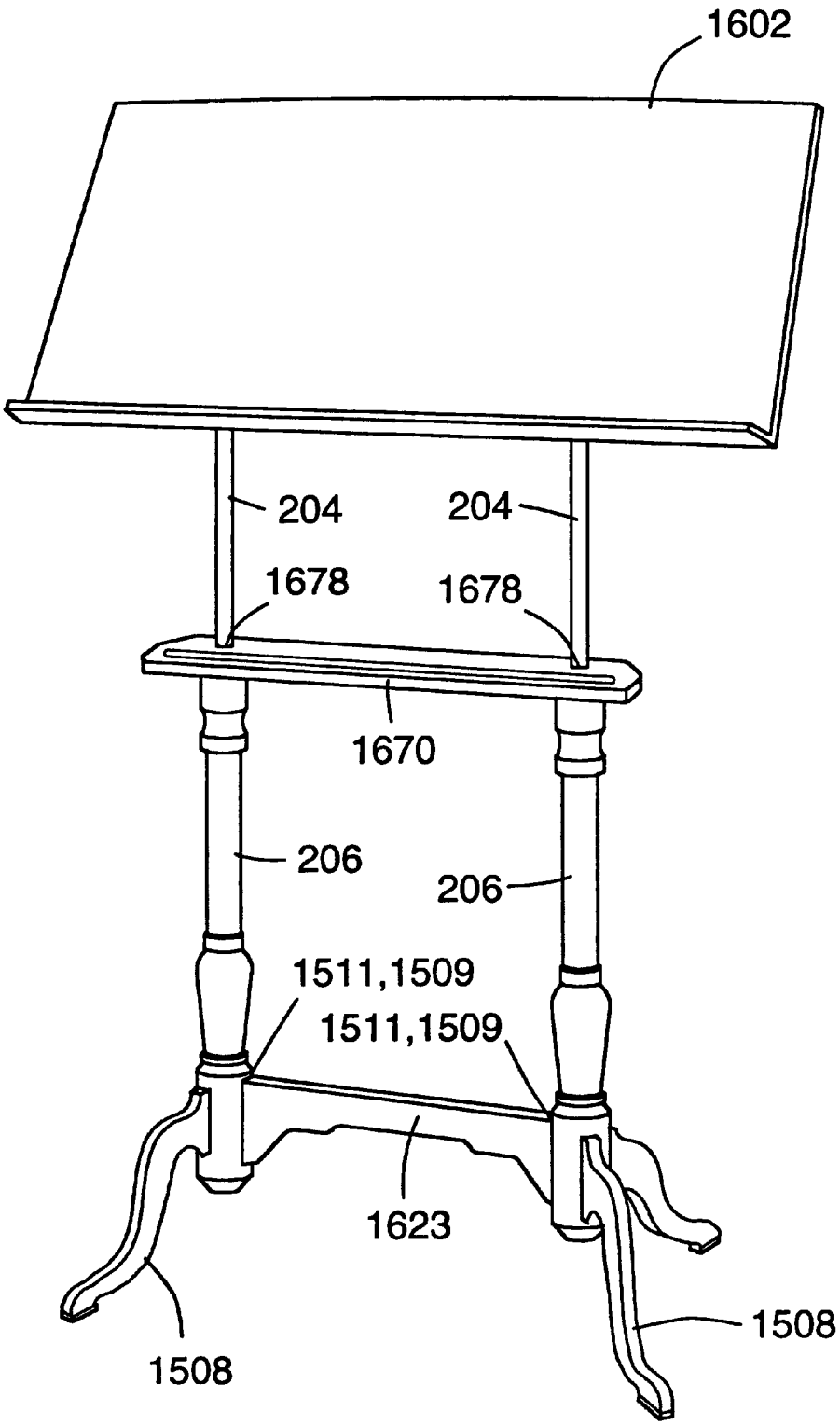
FIG. 16 shows a music stand configurable as a larger unit.
Figure 18A:
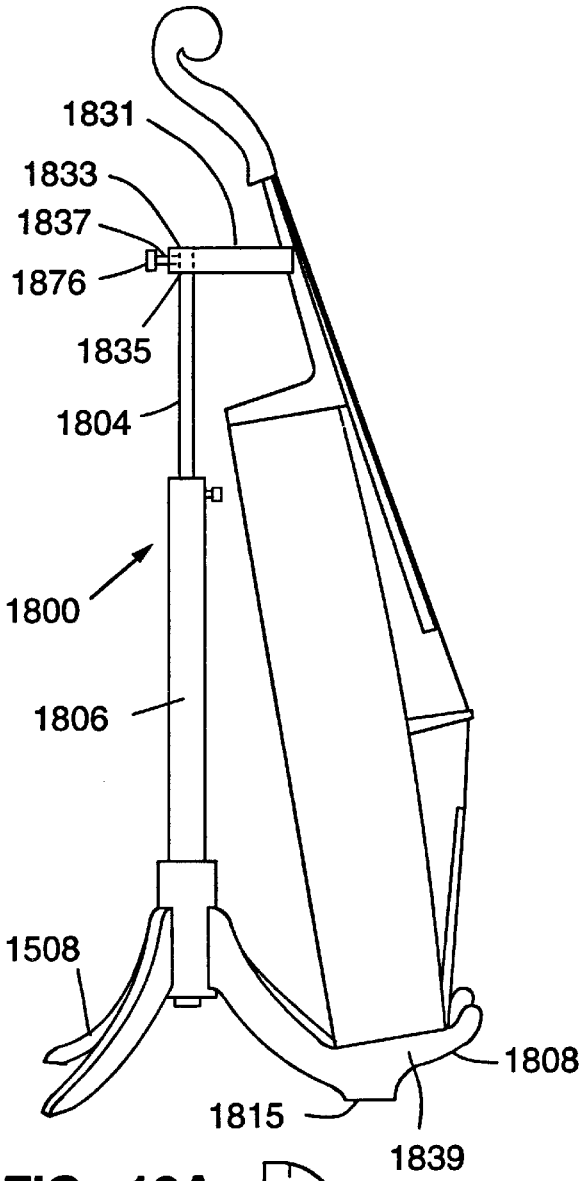
FIG. 18A is a perspective view of a music stand for holding a musical instrument.
Figure 18C:
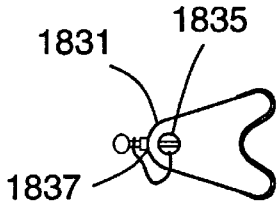
FIGS. 18C–18F show different shapes of instrument neck supports for different instruments.
Figure 18D:
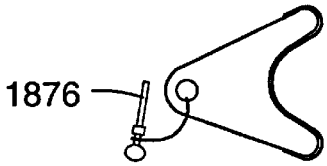
Figure 18E:
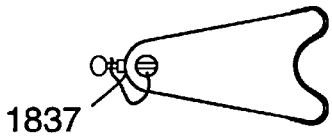
Figure 18F:
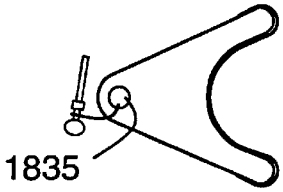
Figure 18B:
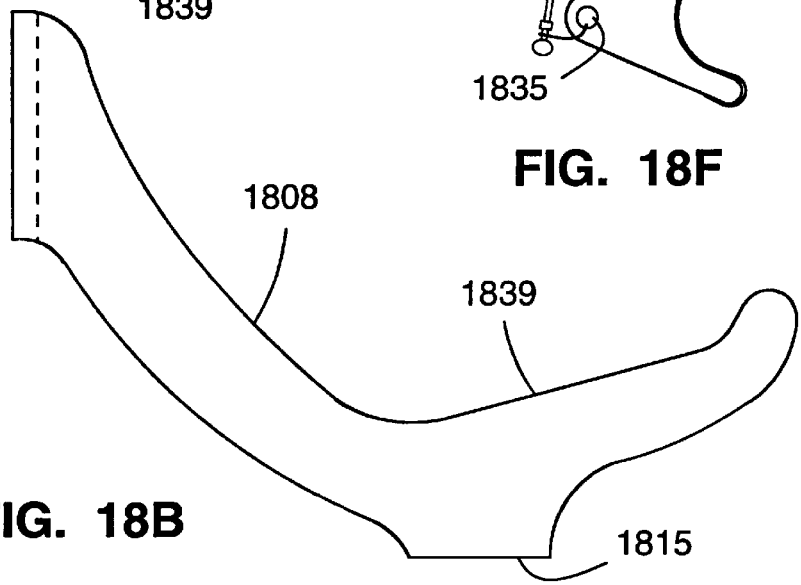
FIG. 18B is a side elevational view of one of the instrument holding legs shown in FIG. 18A.

FIG. 16 shows the music stand configurable as part of a larger unit. Referring to FIG. 16, a preferably larger desk 1602 than that used with earlier described embodiments is coupled with two or more, but preferably two, tilt blocks 658. Each tilt block 658 couples with a dowel 204. Each dowel 204 is a primary dowel 204 in the sense that each dowel 204 integrally engages a spindle 206. In that sense at least two spindles 206 are required, one for each dowel 204.

Each spindle 206 has a peg 1511 which is not coupled with a leg 1508 as shown in FIGS. 15A–15D. Instead one peg 1511 on each spindle 206 is coupled with a spindle connector bar 1623. The same spindle connector bar 1623 attaches to both spindles 1206 via coupling mechanisms substantially similar to those shown in FIGS. 15A–15D. Each of two ends of the spindle connector bar 1623 comprise the complementary component 1509 to the peg 1511 of the spindle 206 of the coupling mechanism.

In the embodiment shown in FIG. 16, a tray 1670 similar to that shown in FIGS. 11A–11D, except that the central cavity 1178 engaging the primary dowel 604 in FIG. 11, is replaced in FIG. 16 by two cavities 1678 equally displaced to either side of the tray 1670 from the position of the cavity 1178 of FIGS. 11A–11D.

FIGS. 17A–17F shows a bookmatched desk 1702 . Referring to FIGS. 17A–17F, the desk 1702 comprises a panel 1725 comprising several strips 1727 of wood cut from the same block 1729 of original wood. After being cut, each strip 1727 of wood of a panel 1725 is rotated ninety degrees, alternatively clockwise and counter-clockwise, and then coupled together with adjacent pieces using an adhesive. Bookmatched desks 1702 coordinate the grains of the strips 1727 of wood to optimize the performance of the desk 1702.

FIGS. 18A–18F shows a music stand which can be used for holding a musical instrument. Referring to FIGS. 18A–18F, the music stand comprises a dowel 1804, a neck support 1831, a spindle 1806, and a plurality of legs 1508, including at least one, but preferably two, special legs 1808 with a downwardly concave upper surface with a minimum height between the end of the leg coupled to the spindle and the free end of the leg configured specially to support a musical instrument.

The spindle 1806 can be any length in a range of lengths which will allow an appropriate height for accommodating the particular size of the instrument. Preferably the height of the stand 1800 is adjustable via incorporation of the height adjustment mechanism 200 shown in FIGS. 2A–2E.

The dowel 1804 of the thirteenth embodiment has a cavity 1833 (see also FIG. 2D) located close to one end of the dowel 1804 going through an entire diameter of the dowel 1804. The neck support 1831 has a first cavity 1835 which is cylindrical and slightly larger in diameter than the diameter of the dowel 1804. The dowel 1804 integrally engages the first cavity 1835 of the neck support 1831.

A neck support 1831 has a second cavity 1837 which is transverse with the first cavity 1835 of the neck support 1831. The first cavity 1835 and the second cavity 1837 of the neck support 1831 have axes of cylindrical symmetry which intersect at the center of the first cavity 1835.

A pin 1876 engages the second cavity 1837 of the neck support 1831 and the cavity 1833 of the dowel 1804 which engages the first cavity 1835 of the neck support 1831, such that the neck support 1831 is coupled with the dowel 1804. The neck support 1831 comprises a contour configured to conform to the contour of the neck of the instrument which is being supported.

Each special leg 1808 has an extended portion 1939 beyond the flat portion 1815 of the special leg 1808 which is coplanar with the floor. The extension of the special leg 1808 curves upward from the floor to engage the base of the musical instrument which is being supported. The special legs 1808 are spaced more closely together than the other legs 1508 which support the stand to balance the torque caused by the positioning of the instrument (off-center of the stand) by an equivalent opposing torque from the floor pushing upward on the each of the special legs 1808.

Figure 19A:
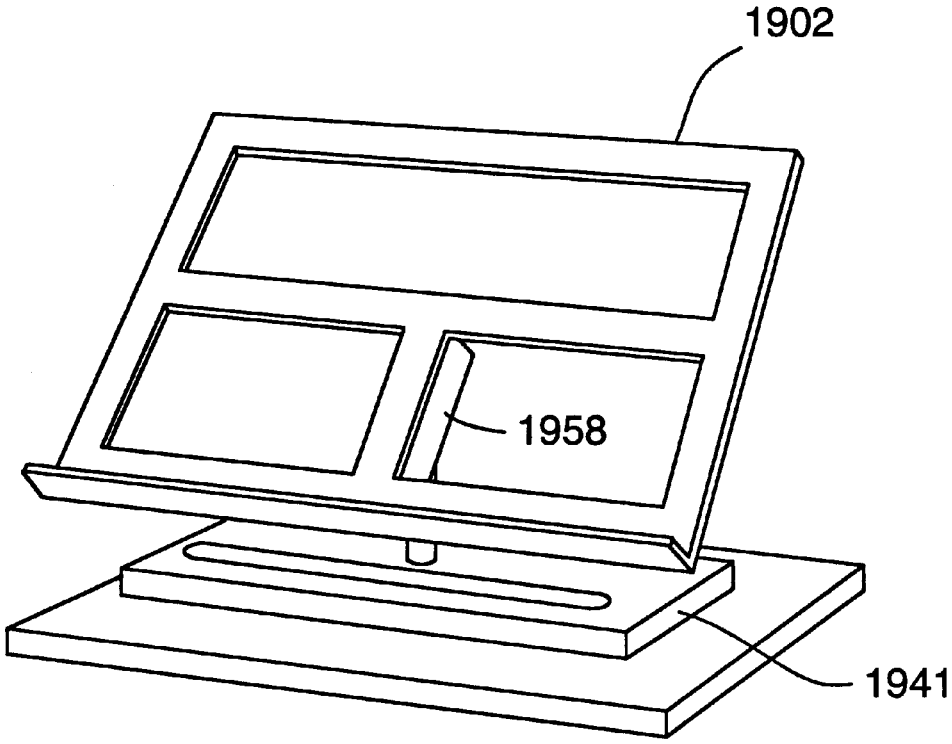
FIG. 19A is a perspective view showing a desk of the music stand configured on a lectern base.
Figure 19B:
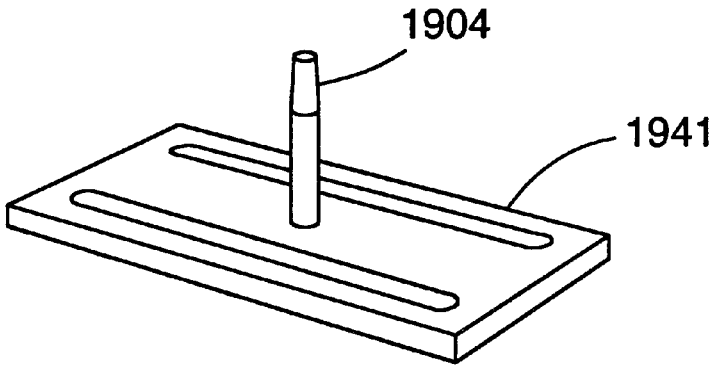
FIG. 19B is a perspective view showing the lectern base without the desk.

FIGS. 19A–19B shows a music stand configured on a lectern base 1941. Referring to FIGS. 19A–19B, a music stand configured on a lectern base 1941 comprises a desk 1902 coupled with a tilt block 1958, a dowel 1904 integrally engaging the tilt block 1958 and a lectern base 1941. The lectern base 1958 couples with the dowel 1904 to cause the dowel 1904 to be vertical. In a preferred embodiment, the tilt block 1958 is similar to that shown in FIGS. 13A–13C and the dowel 1904 is similar to that shown in FIG. 10. The lectern base 1941 is substantially planar such that the lectern base 1941 is coplanar with the object upon which it is resting.

It should be understood that various alternatives to the embodiments of the invention described herein may be employed in practicing the invention. It is intended that the following claims define the scope of the invention and that methods and apparatus within the scope of these claims and their equivalents be covered thereby.

I claim:

1. A stand for supporting literary and musical works comprising:

a desk means;

at least one dowel, including a primary dowel, said primary dowel including a groove, said groove providing the outside surface of the dowel and being substantially parallel to axis of rotational symmetry of said primary dowel;

a tilt block coupled to both said desk means and said one dowel;

a spindle including an axial cavity and at least one transverse cavity, said spindle being coupled adjustably to said primary dowel, said axial cavity being substantially coaxial with both said spindle and said primary dowel;

a plurality of legs, each of said plurality of legs being coupled to said spindle to support said spindle;

a height adjustment means comprising a guide wire coupled with said spindle and extending into said axial cavity of said spindle, said guide wire frictionally engaging said groove of said primary dowel, a threaded insert embedded in said spindle and centered on said transverse cavity integrally engages said threaded insert, and a screw means engaged with said threaded insert and said guide wire for adjusting normal force at which said guide wire engages said groove of said primary dowel.

2. A stand as set forth in claim 1, wherein said screw means comprises first and a second threaded portions and an unthreaded portion therebetween, such that said screw means is not decoupled from said threaded insert unless said screw means is rotationally disengaged from both first and second threaded portions.

3. A stand as set forth in claim 1, wherein said screw means is configured to rotate in one direction to cause said guide wire to flex toward radial center of said spindle increasing normal force between said groove of said primary dowel and said guide wire and to rotate counter to said one direction to decrease normal force between groove and said guide wire.

4. A stand for supporting literary and musical works comprising:

a desk means;

at least one dowel, including a primary dowel, said primary dowel including a groove, said groove provided in the outside surface of the dowel and being substantially parallel to axis of rotational symmetry of said primary dowel;

a tilt block coupled to both said desk means and said one dowel;

a spindle including an axial cavity and at least one transverse cavity, said spindle being coupled adjustably to said primary dowel, said axial cavity being substantially coaxial with both said spindle and said primary dowel;

a plurality of legs, each said plurality of legs being coupled to said spindle to support said spindle;

a height adjustment means comprising a guide wire coupled with said spindle and extending into said axial cavity of said spindle, said guide wire frictionally engaging said groove of said primary dowel, a threaded insert embedded in said spindle and centered in said transverse cavity, and a screw engaged with said threaded insert and said guide wire for adjusting the normal force at which said guide wire engages said groove of said primary dowel; and at least one yoke, including a primary yoke, said primary yoke being coupled to both said primary dowel and at least one secondary dowel coupled with said tilt block.

5. A stand for supporting literary and musical works as set forth in claim 4, wherein said primary yolk engages a first secondary dowel coupled with a first tilt block, said first tilt block coupling with a first desk means, and a second secondary dowel coupled with a second tilt block, said second tilt block coupling with a second desk means.

6. A stand for supporting literary and musical works as set forth in claim 4, including a first secondary dowel coupling with a first title block, said first tilt block coupling with a first desk means, and a second secondary dowel coupling with said second yoke, said second yoke engaging at least one secondary dowel, each said secondary dowel which engages said second yoke further engaging one said tilt block, each said tilt block engaging a desk means.

7. A stand as set forth in claim 6, including a third yoke;

said primary yolk engages a first secondary dowel coupling with said second yoke, said second yoke engaging at least one secondary dowel, each said secondary dowel which engages said second yoke further engaging one said tilt block, each said tilt block engaging a desk means, and a second secondary dowel coupling with said third yoke, said third yoke engaging at least one secondary dowel, each said secondary dowel which engages said third yoke engaging a tilt block, each said tilt block engaging a desk means.

8. A stand as set forth in claim 1, wherein each said at least one dowel comprises a right circular cylindrical base, said base including a base radius, and a tapered end, said tapered end having a tapered radius which decreases at a substantially two degree angle to the axis of rotation of said dowel from a location along said dowel having said base radius to a circular end of said dowel having a smaller radius, such that said smaller radius of said circular end is less than said base radius of said right circular cylindrical base.

9. A stand as set forth in claim 1, wherein said stand further comprises at least one lamp means and at least one bracket, said one bracket coupling with said one lamp means, and said tilt block couples with said bracket, said tilt block having a slot configured for coupling with said bracket.

10. A stand as set forth in claim 9, wherein said slot is substantially parallel with a flat surface of said desk means and a flat surface of said tilt block;

three sides of said tilt block include the slot, such that the slot is U-shaped;

said tilt block further comprises a width away from said slot and a width at said slot, said width at said slot being smaller than said width away from said slot; and said bracket includes a rectangular notch having a width, said width of said rectangular notch being smaller than said width of said tilt block away from said slot and larger than said width of said tilt block at said slot, such that said bracket couples firmly with said tilt block.

11. A stand as set forth in claim 1, wherein said stand further comprises a tray coupled to said primary dowel, and a pin engaged with said primary dowel such that said pin and said primary dowel support said tray.

12. A stand as set forth in claim 11, wherein said tray further includes at least one candle arm coupled with said tray, and at least one candle holder coupled with said candle arm.

13. A stand as set forth in claim 1, wherein each said tilt block includes a plurality of cavities, each of said plurality of cavities having a different pitch such that said desk means is oriented at different angles determined by which of said plurality of cavities engages said primary dowel.

14. A stand as set forth in claim 1, wherein at least one said desk means further comprises tabs coupled to said desk means, said desk means having a width and said tabs being pivotably adjustable to effectively extend width of said panel to provide wider support for said literary and musical works, said tabs including a coupling mechanism comprising a neoprene rubber washer of substantially sixty durometer hardness, such that said tabs are pivotably adjustable by human hand and such that tabs do not pivot in response to gravity.

15. A stand for supporting literary and musical works as set forth in claim 1, wherein said legs are readily attachable and detachable from said spindle.

16. A stand for supporting literary and musical works as set forth in claim 1, wherein stand further comprises:

a second tilt block coupled to said desk means;

a second primary dowel coupled to said second tilt block;

a second spindle coupled adjustably to said second primary dowel; and a spindle connector means, said spindle connector means being coupled with said spindle and said second spindle.

17. A stand as set forth in claim 1, wherein said desk includes a panel, said panel comprising coupled portions of wood, wherein said portions are cut from a single block of wood, are rotated by ninety degrees from original relative orientation with respect to other pieces in single block, and are coupled together, adjacent pieces being rotated in opposite directions, such that said panel of said desk is bookmatched.

18. A stand as set forth in claim 4, wherein said primary dowel is substantially longer than each said secondary dowel.

19. A stand as set forth in claim 1, wherein said guide wire is U-shaped such that said guide wire has a central segment, a first prong and a second prong.

20. A stand as set forth in claim 19, wherein said guide wire is comprised of flexible material.

21. A stand as set forth in claim 20, wherein central segment is arched.

22. A stand as set forth in claim 19, wherein said central segment of said guide wire is substantially parallel with and engaged with said groove of said primary dowel.

23. A stand as set forth in claim 19, wherein said screw means engages said first prong of said guide wire.

24. A stand for supporting literary and musical works comprising:

a desk means;

at least one dowel, including a primary dowel, each said at least one dowel comprising a right circular cylindrical base, said base including a base radius, and a tapered end, said tapered end having a tapered radius which decreases at a substantially two degree angle to the axis of rotation of said dowel from a location on said dowel having said base radius to a circular end of said dowel having a smaller radius, such that said smaller radius of said circular end is less than said base radius of right circular cylindrical base;

a tilt block coupling to said desk means and engaging said primary dowel;

a spindle coupled adjustably to primary dowel; and a plurality of legs, each of said plurality of legs being coupled to said spindle to support said spindle.

25. A stand for supporting literary and musical works comprising:

a desk means;

at least one dowel, including a primary dowel;

a spindle coupled adjustably to said primary dowel;

a plurality of legs, each of said plurality of legs being coupled to said spindle to support said spindle;

a lamp means;

a bracket coupled with said lamp means;

a tilt block coupled to said desk means, said primary dowel and said bracket, said tilt block comprising a U-shaped slot having side walls configured for coupling with said bracket, wherein the bracket slides into the slot and is held mechanically in place by the walls of the slot.

26. A stand as set forth in claim 25, wherein said tilt block further comprises a width away from said slot; and a width at said slot, said width at said slot being smaller than said width away from said slot, said bracket includes a rectangular notch having a width, said width of said rectangular notch being smaller than said width of said tilt block away from said slot and larger than said width of said tilt block at said slot, such that said bracket couples firmly with said tilt block.

27. A stand as set forth in claim 26, wherein said slot is substantially parallel with a flat surface of said desk means and a flat surface of said tilt block and wherein three sides of said title block include the slot, such that the slot is U-shaped.

28. A stand for supporting literary and musical works comprising:

a desk means;

a primary dowel;

a spindle coupled adjustably to primary dowel;

a plurality of legs, each of said plurality of legs being coupled to said spindle to support said spindle; and a tray coupled to said primary dowel.

29. A stand as set forth in claim 28, wherein said stand further comprises a pin which engages said primary dowel such that said pin supports said tray.

30. A stand as set forth in claim 28, wherein said tray further includes at least one candle arm coupled with said tray, at least one candle holder coupled with said candle arm, and at least one candle coupled with said candle holder.

31. A stand comprising:

a dowel;

a spindle coupled adjustably to said dowel; and a plurality of legs, each of said plurality of legs being coupled to said spindle to support said spindle, wherein at least one of said legs is configured to further support a musical instrument from the bottom of said instrument.

32. A stand as set forth in claim 31, wherein each of said legs configured to support a musical instrument is substantially concave such that the curvature of each of said legs is configured to support a musical instrument.

33. A stand, comprising:

a dowel:

a spindle coupled adjustably to said dowel: and a plurality of legs, each of said plurality of legs being coupled to said spindle to support said spindle, wherein at least one of said legs is configured to further support a musical instrument, wherein said dowel includes a groove, said groove being substantially parallel to axis of rotational symmetry of said dowel;

said spindle includes a cylindrical cavity, said spindle being coupled adjustably to said primary dowel, said cavity being substantially coaxial with both said spindle and said primary dowel; and said stand further comprises a height adjustment means comprising:

a guide wire coupled with said spindle and extending into said cavity of said spindle, said guide wire frictionally engaging said groove of said primary dowel, a screw means engaged with said guide wire for adjusting normal force at which said guide wire engages said groove of said primary dowel, and a threaded insert embedded in said spindle such that said screw means integrally engages said threaded insert.

34. A stand, comprising:

a dowel;

a spindle coupled adjustably to said dowel; and a plurality of legs, each of said plurality of legs being coupled to said spindle to support said spindle, wherein at least one of said legs is configured to further support a musical instrument, wherein each of said legs configured to support a musical instrument exhibits a minimum height which is located at the lowest vertical position of any part of the stand, said minimum height being located between the end of each leg which is coupled to said spindle and the other end of each said leg which substantially supports said musical instrument.

35. A stand, comprising:

a dowel;

a spindle coupled adjustably to said dowel; and a plurality of legs, each of said plurality of legs being coupled to said spindle to support said spindle, wherein at least one of said legs is configured to further support a musical instrument, wherein said stand further comprises a neck support coupled to said primary dowel, said neck support being configured to further support said musical instrument.

36. A stand, comprising:

a dowel;

a spindle coupled adjustably to said dowel; and a plurality of legs, each of said plurality of legs being coupled to said spindle to support said spindle, wherein at least one of said leas is configured to further support a musical instrument, wherein said primary dowel comprises a first cavity, said first cavity extending through a diameter of said primary dowel and engaging a pin, said pin further engaging said neck support, such that pin couples said neck support with said primary dowel.

37. A stand, comprising:

a dowel;

a spindle coupled adjustably to said dowel; and a plurality of legs, each of said plurality of legs being coupled to said spindle to support said spindle, wherein at least one of said legs is configured to further support a musical instrument, wherein said legs are not spaced at equal angles around said spindle, said legs configured to further support a musical instrument are more closely spaced than legs not configured to further support a musical instrument.

38. A stand comprising:

a base support, a spindle including an axial cavity, a primary dowel slidably supported within said spindle, a primary yoke rotatably and removably supported midway thereof on the upper end of said primary dowel, said primary yoke having a secondary dowel located at each of its opposite ends for receiving a desk or another yoke.

39. The stand of claim 38 including a first tilt block coupling a first desk to one of said secondary dowels and a second tilt block coupling a second desk to the other of said secondary dowels.

40. The stand of claim 38 including first and second secondary yokes, each of said secondary yokes rotatably and removably supported midway thereof from the upper end of one of said secondary dowels.

41. The stand of claim 38 wherein said primary dowel includes a groove in the outside surface thereof and extending substantially parallel to the longitudinal axis of said primary dowel and a height adjusting means comprising a guide wire coupled with said spindle and extending into the axial cavity of said spindle, a threaded insert embedded in said spindle and centered on said axial cavity thereof and a screw engaging said threaded insert and said guide wire for adjusting the force at which said guide wire engages said groove of said primary dowel.

42. The stand of claim 38 including a tray coupled to said primary dowel and a pin engaged with said primary dowel such that said pin and said primary dowel support said tray.

* * * * *